US005802634A

United States Patent [19]

Onishi et al.

[11] Patent Number: 5,802,634

[45] Date of Patent: Sep. 8, 1998

[54] BED WITH HEIGHT ADJUSTING MEANS, CONVERTIBLE FROM INFANT USE TO ADULT USE

[75] Inventors: Ichiro Onishi; Kenzou Kassai, both of Osaka, Japan

[73] Assignee: Aprica Kassai Kabushikikaisha, Osaka, Japan

[21] Appl. No.: 750,732

[22] PCT Filed: Apr. 17, 1996

[86] PCT No.: PCT/JP96/01040

§ 371 Date: Dec. 17, 1996

§ 102(e) Date: Dec. 17, 1996

[87] PCT Pub. No.: WO96/32870

PCT Pub. Date: Oct. 24, 1996

[30] Foreign Application Priority Data

Apr. 21, 1995 [JP] Japan ..... 7-096847
Oct. 18, 1995 [JP] Japan ..... 7-270052

[51] Int. Cl.[6] ..... A47D 7/01; A47D 15/00; A47D 7/00

[52] U.S. Cl. ..... 5/93.2; 5/11; 5/93.1; 5/53.1; 5/108; 40/727; 40/747

[58] Field of Search ..... 5/93.2, 93.1, 11, 5/611, 661, 53.1, 108, 105, 107; 297/344.15, 130; 40/727, 747

[56] References Cited

U.S. PATENT DOCUMENTS

| | | | |
|---|---|---|---|
| 743,495 | 4/1903 | Hanley | 5/93.2 |
| 2,698,442 | 1/1955 | Travis | 5/11 |
| 2,932,344 | 4/1960 | Levi | 297/344.15 |
| 3,848,277 | 11/1974 | Reguitti . | |
| 3,900,907 | 8/1975 | Mulder . | |

FOREIGN PATENT DOCUMENTS

| | | | |
|---|---|---|---|
| 2642962 | 8/1990 | France | 5/611 |
| 50-140765 | 11/1975 | Japan . | |
| 51-24444 | 6/1976 | Japan . | |
| 58-185966 | 12/1983 | Japan . | |
| 60-65064 | 5/1985 | Japan . | |
| 61-73271 | 5/1986 | Japan . | |
| 64-30049 | 2/1989 | Japan . | |
| 1-90461 | 6/1989 | Japan . | |
| 1-112768 | 7/1989 | Japan . | |
| 6-7557 | 2/1994 | Japan . | |

*Primary Examiner*—Alexander Grosz
*Attorney, Agent, or Firm*—W. F. Fasse; W. G. Fasse

[57] ABSTRACT

An adjustable bed, suitable for use from infancy to adulthood includes a bed frame body having pivoting end panels and a height adjustable base. In one adjusted position, with the end panels pivoted to near vertical and the height adjustable base fully raised, the bed is swingable like a cradle, with the bed frame body swingably suspended from the height adjustable base. By lowering the height adjustable base, the near vertical end panels contact the floor, and the bed is useful as a playpen for an infant or a chair for an adult. By pivoting the end panels to intermediate or horizontal positions, the bed becomes useful as a lounge chair or as a bed for a child. With the height adjustable base at its lowest, and the end panels pivoted to horizontal positions, the bed may be used as a rigid support for an adult mattress. To achieve these features, the bed frame body includes the end panels (4, 5) pivotably connected to each other by first and second coupling members (8, 9) extending therebetween, and the adjustable base includes first and second base members (10, 11) that extend parallel to the coupling members (8, 9) and that are supported by height adjustable leg arrangements (6, 7) that are articulately bendable to adjust the height of the base members. First and second swing shafts (12, 13) swingably suspend the lower ends of the end panels (4, 5) from outer ends of the base members (10, 11).

25 Claims, 29 Drawing Sheets

BED WITH HEIGHT ADJUSTING MEANS, CONVERTIBLE FROM INFANT USE TO ADULT USE

TECHNICAL FIELD

The present invention relates to a bed, and more specifically, it relates to the structure of a bed which can be used by respective generations from an infant to an adult.

BACKGROUND TECHNIQUE

In general, beds include a great variety of ones from baby beds for infants to beds for adults. The beds for babies include for example, such a one that the bed itself swings, and another for employing the interior of the bed as a playpen. On the other hand, beds for adults include for example, those that are employed as a chair in the daytime and employed as a bed in the nighttime. There is also, for example, such a one that reclining mechanisms are provided on both end portions of the bed.

However, the aforementioned conventional various beds have limited use. The baby bed for an infant, for example, cannot be used when the child grows up. If an infant is laid down on a bed for an adult, then the infant will not be as comfortable as in a baby bed.

DISCLOSURE OF THE INVENTION

An object of the present invention is to provide a bed comprising all of the functions for serving as a baby bed for an infant and the functions of a bed for an adult, which has been proposed in order to overcome such limitations of the prior art.

Another object of the present invention is to provide a bed from which the parents' love, and the bonds with the parents, can be perceived in a bed for an infant which can be employed up to the time a person is an adult.

One embodiment of the present invention comprises a bed part, a frame body enclosing the periphery of the above bed part, which is adaptable for changing the area of the above bed part by changing its form, and height adjusting means supporting the above bed part for adjusting the height of the above bed part from a floor face.

Preferably, the above frame body has a slide mechanism which moves in the vertical direction with respect to the above bed part.

Preferably, the above height adjusting means has a leg part for adjusting the height of the above bed part from the floor face by being bent or pivoted in an inverted V shape from a substantially central portion.

Preferably, the above bed part is swingably supported with respect to the above height adjusting means by being coupled to a swing shaft which is provided on the above height adjusting means.

Preferably, the above frame body is provided with a mounted frame storing an affectionate message from parents to their child or the like, which is detachable with respect to the above frame body.

Due to the above structure, it is possible to provide a bed which can be used by respective generations from an infant to an adult, by changing the form of the frame body thereby changing the area of the bed part.

Next, a general embodiment of a bed, according to the present invention, comprises a bed part, a pair of panels, each reclinably mounted about an axis part provided in the vicinity of each end of the above bed part, and a bed base part for adjusting the height, from the floor, of a bed frame body including the above bed part and the above pair of panels, while also swingably supporting the above bed frame body. Further, the above bed frame body and the above bed base part are coupled with each other by swing shafts. The swing shafts extend downwardly from pivot axes located near each end of the bed base part. The lower ends of the swing shafts engage slots that are provided in the panels, so that the panels may be supported by the swing shafts. When the panels are in their most vertical position, i.e. least reclined, the panels rest on the lower ends of the swing shafts and the upper surface of the bed part is above the upper surface of the bed base part.

Due to the above structure, the bed frame body becomes swingable with respect to the bed base when the panels are in the most vertical, i.e. least reclined position. In this state, the bed can be employed as a swingable baby bed for an infant by providing side walls on both sides between the pair of panels, for example. In another state, the bed can be employed as a fixed baby bed or a playpen for a baby by bringing the panel lower end portions into contact with the floor face. In this state, the bed frame body is not able to swing. The bed can also be employed as a chair for an adult by providing a side wall only on one side.

In yet another state, the bed can be adjusted into a proper bed length responsive to a child's growth by gradually inclining the pair of panels with respect to the bed part, while the bed can be employed for an adult by inclining the pair of panels until they are flush with the bed part.

Next, a more specific embodiment of the bed based on the present invention comprises a bed frame body, having a first coupling member, or rail, and a second coupling member, or rail, which are arranged in parallel with each other (and which may provide support for a box spring and/or mattress), and reclinable first and second panels which are pivotally supported by axis parts provided in the vicinity of both end portions of the respective first coupling member and second coupling member so that the substantially central portions of the first and second panels are rotatably held. The bed also comprises a bed frame base, having a first base member and a second base member which are arranged in parallel with the above first coupling member, or rail, and the above second coupling member, or rail, for making the height of the bed frame body adjustable relative to the floor surface while swingably supporting the above bed frame body, and also holding the above first coupling member and the above second coupling member from both sides. Further, the above bed frame body may be coupled with the bed frame base by a first swing shaft and a second swing shaft. Both the first and second swing shafts may be "U" shaped, each swing shaft having its first upper end in a pivotal connection with the first base member and its second upper end in a pivotal connection with the second base member, and having a lower, horizontal connecting portion. The first panel may have an inverted "U" shaped slot in its lower portion, for engaging the lower, horizontal connecting portion of the first swing shaft, so that the first panel may be supported by the first swing shaft. The second panel and second swing shaft may be arranged similarly to the first panel and first swing shaft. When the panels are in their most vertical positions, i.e. least reclined, the panels may rest on the lower, horizontal connecting portions of the swing shafts, and in this state, a plane passing through the upper surfaces of the coupling members, or rails, is positioned above the upper surfaces of the base members.

By employing the above structure, when the first and second panels are in their most vertical, i.e. least reclined, position, the bed frame body becomes swingable with respect to the first base member, and the second base member, similarly to the bed in accordance with the general embodiment, whereby the bed can be employed as a swingable baby bed for an infant by providing side walls on both sides between the first panel and the second panel, for example. In an alternate state the bed can be employed as a fixed baby bed or a playpen by bringing the lower end portions of the first panel and the second panel into contact with the floor face. In this state, the bed can not swing. In this state, the bed can also be used as a chair for an adult by providing a side wall only on one side.

In additional states, the bed can be adjusted into a proper bed length responsive to a child's growth by gradually inclining the first panel and the second panel with respect to the first base member and the second base member, while the bed can be employed for an adult by inclining the first panel and the second panel until the same are flush with the first base member and the second base member.

Preferably, the above first base member comprises a first base bar which is arranged in parallel with respect to the above first coupling member and is provided with the above pivotal part, and a first inverted "V" shaped leg part which is mounted on the above first base bar to be capable of adjusting the height of the above first base bar from a floor face by being "bent" or pivoted at a substantially central portion i.e. making the inverted "V" narrow and tall, or wide and short, while the above second base member comprises a second base bar which is arranged in parallel with respect to the above second coupling member and provided with the above pivotal part, and a second inverted "V" shaped leg part which is mounted on the above second base bar to be capable of adjusting the height of the above second base bar from the floor face by "bending" or pivoting at a central portion, i.e. by making the inverted "V" narrow and tall, or wide and short.

Due to this structure, it is possible to freely adjust the height of the bed frame body from the floor face by adjusting the configuration of the first leg part and the second leg part, and it is possible to employ the bed while properly adjusting the height in response to growth stages from a baby to an adult.

Preferably, a first auxiliary member is provided between the first base bar and the second base bar, such that when the first and second panels are in their horizontal positions, i.e. most reclined, the lower surfaces of the first and second coupling members, or rails, will rest on the upper surface of the auxiliary member.

Due to this structure, it is achieved that the first coupling member and the second coupling member are supported by the first auxiliary member from below when the bed is employed as a bed for an adult in the state that the first panel and the second panel are most inclined, whereby it is possible to improve rigidity of the bed.

Preferably, a second auxiliary member is provided between the first leg part and the second leg part, such that when the first and second leg parts are adjusted to their lowest position, i.e. the inverted "V", becomes a horizontal line, and the first and/or second panels are in their most reclined position, the lower surfaces of the first and/or second panel will rest on the upper surface of the second auxiliary member.

Due to this structure, it is achieved that the first panel and the second panel are supported by the second auxiliary member from below when the bed is employed as a bed for an adult, whereby it is possible to improve rigidity of the bed.

A further aspect based on the present invention relates to a bed for an infant, the length of which can be changed in response to the growth of the infant, and comprises a headboard extending along the width direction of the bed on an edge positioned on a head side, and a picture frame detachably mounted on the headboard for storing an affectionate message from parents to their child or the like.

Thus the child can grow up while appropriately feeling the parents' love and the bonds with the parents and having a docile heart, by providing the detachably mounted picture frame for storing an affectionate message from the parents to the child or the like on the headboard, such that the child can sometimes take a look at the message or the like stored in this picture frame.

In a preferred embodiment, a picture frame in which a cartoon, a photograph and the like can be inserted on both sides is provided on the headboard part, so that a landscape or a cartoon pleasing the child is inserted in one surface and a photograph or a message card from which the love from the parents to the child or the bonds between the parents and the child can be confirmed is inserted in the other surface side in the daily life, whereby the child can grow up while appropriately feeling the parents' love and the bonds with the parents, and can have a docile heart by sometimes taking a look at the other surface side of this frame.

Further, it is possible to make the aforementioned picture frame efficiently exhibit either surface by employing a structure capable of vertically rotatably storing the picture frame in an opening part provided in the headboard or employing a structure of storing the picture frame in a recess provided on the headboard in an embedding manner, so that the child appropriately confirms the parents' love and the bonds with the parents in a more preferable state and can grow up while achieving a happy and docile heart.

Also in such case that the bed becomes unnecessary, the picture frame can be stood up on a desk or the like when the child grows, by detaching the picture frame and bringing the same into a self-sustainable structure. Consequently, the parents' love and the bonds with the parents that have been associated or transformed into the bed used from the infanthood are also transformed into the picture frame, whereby the child can appropriately remember the parents' love and the bonds with the parents by taking a look at the picture frame.

DETAILED DESCRIPTION OF EXAMPLE EMBODIMENTS AND BEST MODES FOR CARRYING OUT THE INVENTION (Embodiment 1)

An embodiment 1 of a bed based on the present invention is now described with reference to the drawings. First, FIG. 1 is a general perspective view showing the structure of a bed 1 of this embodiment, and FIG. 2 is a sectional view along arrow of the line B—B in FIG. 1.

Figure 1:
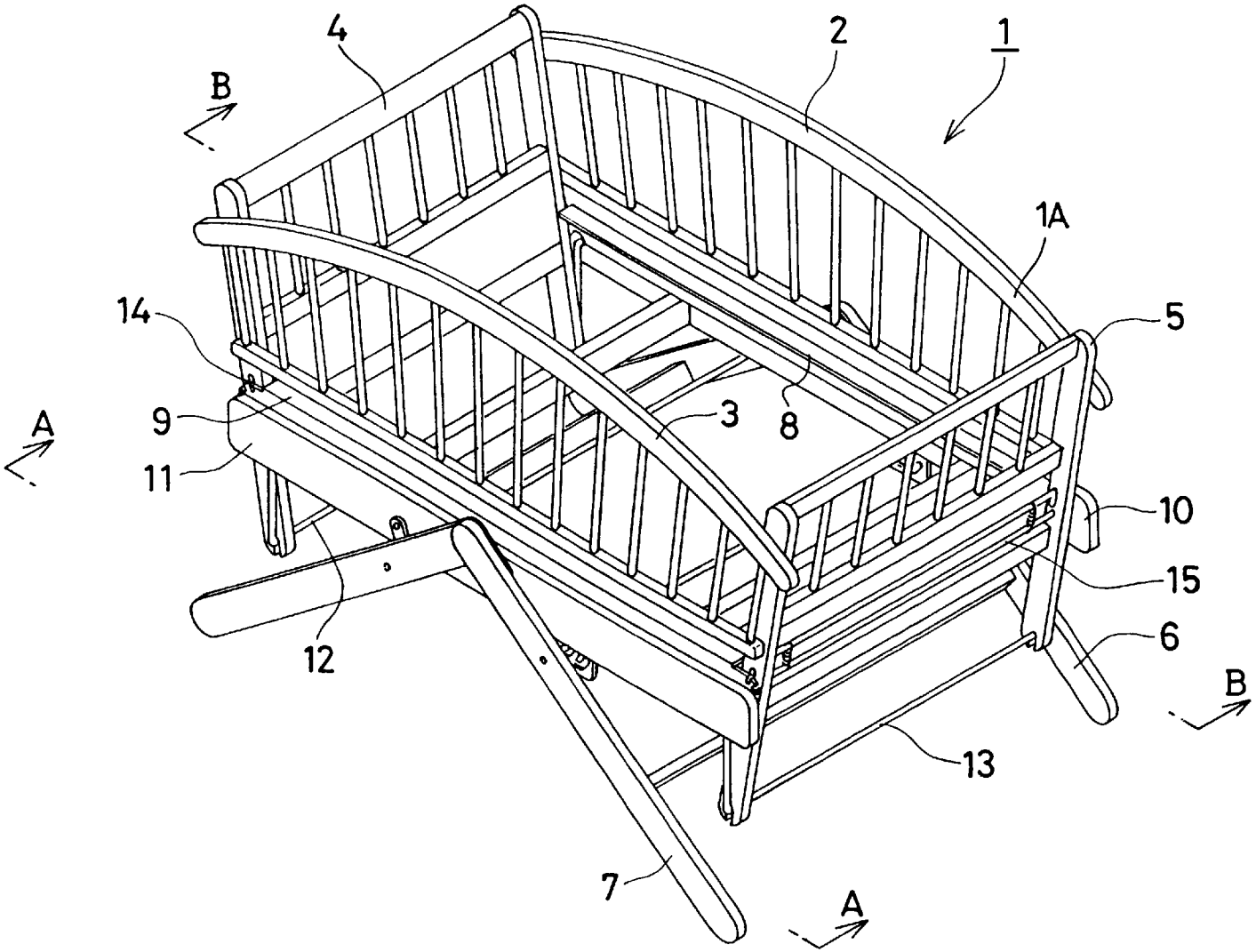
FIG. 1 is a perspective view showing the structure of a bed in an embodiment 1 based on the present invention.
Figure 2:
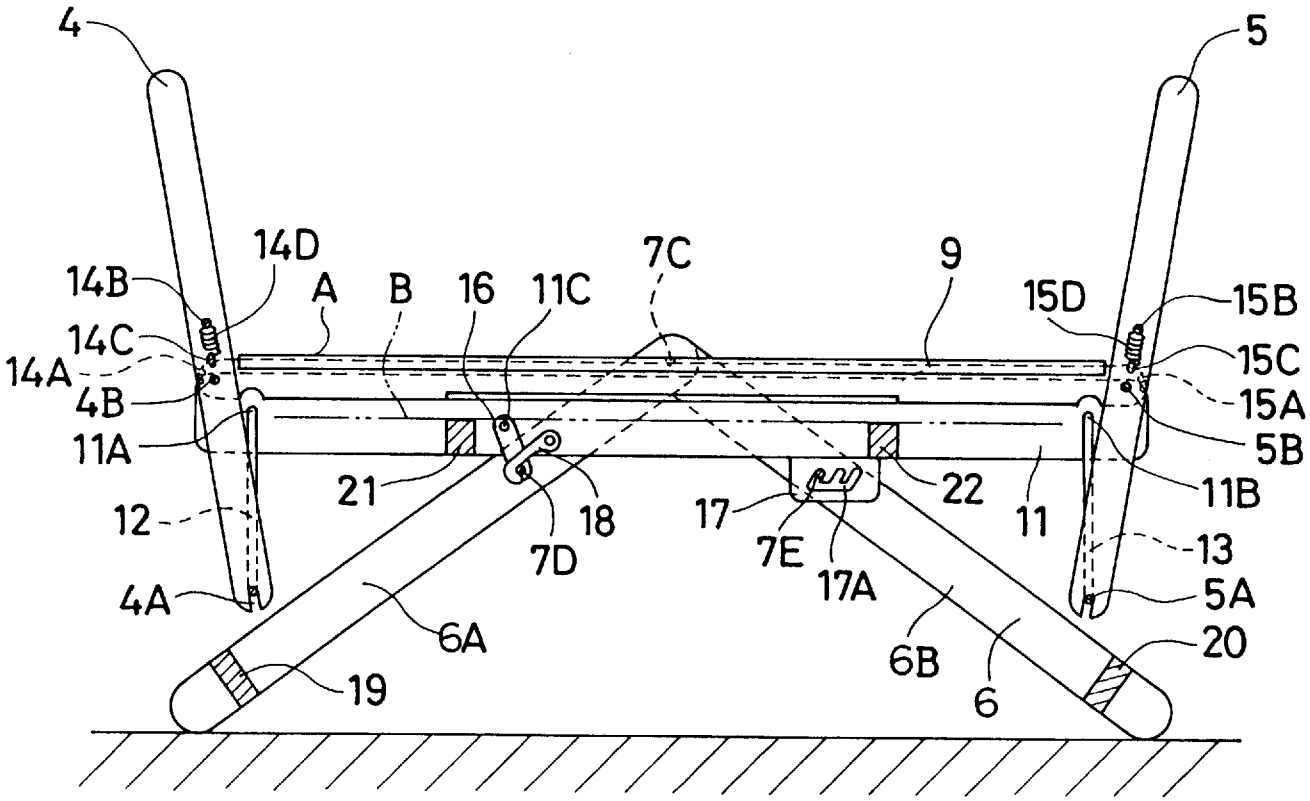
FIG. 2 is a sectional view along arrow of the line B—B in FIG. 1.

First, with reference to FIG. 1 and FIG. 2, this bed 1 comprises a first coupling member, or rail, 8 and a second coupling member, or rail, 9 which are arranged in parallel with each other. On both end portions of the first coupling member 8 and the second coupling member 9, a first panel 4 and a second panel 5 which are mounted to be inclinable about axis parts 4B and 5B respectively are provided.

As to adjustment of inclination angles of the first panel 4 and the second panel 5, lock bars 14C and 15C engage in a plurality of notched grooves 14A and 15A which are provided on prescribed circumferences on both end portions of the first coupling member, or rail, 8 and the second coupling member, or rail, 9 as shown in FIG. 2, whereby the inclination angles of the first panel 4 and the second panel 5 can be adjusted. Springs 14D and 15D are mounted on fixed bars 14B and 15B for supplying urging force for these lock bars 14C and 15C for engaging in the notched grooves 14A and 15A. A bed frame body is formed by the aforementioned first coupling member, or rail, 8, the second coupling member, or rail, 9, the first panel 4 and the second panel 5.

In a state in which the first panel 4 and the second panel 5 are most raised together, i.e. most nearly vertical, protective fences 2 and 3 can be mounted on both sides of the first panel 4 and the second panel 5, as shown in FIG. 1.

On both sides of the first coupling member, or rail, 8 and the second coupling member, or rail, 9, a first base bar 10 and a second base bar 11 are arranged in parallel with respect to the first coupling member 8 and the second coupling member 9. Pivotal parts 11A and 11B are provided in the vicinity of both end portions of the first base bar 10 and the second base bar 11 respectively. A first swing shaft 12 and a second swing shaft 13 are pivotally supported by these pivotal parts 11A and 11B. Inverted U-shaped grooves form sliding parts 4A and 5A provided on lower end portions of the first panel 4 and the second panel 5, which engage swing shafts 12 and 13 respectively.

Due to this first shaft 12 and the second shaft 13, the aforementioned bed frame body is swingable with respect to the first base bar 10 and the second base bar 11. Between the first base bar 10 and the second base bar 11, base coupling bars 21 and 22 are mounted on prescribed positions, to maintain the parallel relationship of base bars 10 and 11.

The first base bar 10 and the second base bar 11 are provided with a first leg part 6 and a second leg part 7 for controlling the heights of the first base bar 10 and the second base bar 11 from a floor face respectively. The first leg part 6 comprises leg segments 6A and 6B, and the second leg part 7 comprises leg segments 7A and 7B. Leg parts 6 and 7 may each be bent about a rotation axis, e.g. 7C at central portions thereof, i.e. by pivoting leg segments 6A, 6B or 7A, 7B. Lock shafts 7D and 7E are extended between the first leg part 6 and the second leg part 7. Lock shaft 7E engages with fixed grooves 17A of fixed plates 17 provided on the first base bar 10 and the second base bar 11. Lock shaft 7D engages lock pins 18, thereby making the heights of the first base bar 10 and the second base bar 11 adjustable relative to the floor face.

The lock shaft 7D is coupled to rotary plates 16 which are provided on the first base bar 10 and the second base bar 11. Rotary plates 16 are rotatable with respect to a fixed axis 11C, to provide a structure enabling adjustment in the height direction with no change of the right-left directional position of the rotation axis 7C of the first leg part 6 and the second leg part 7. Leg part coupling bars 19 and 20 are provided between the first leg part 6 and the second leg part 7 respectively, to maintain the parallel relationship of leg parts 6 and 7.

Next, various possible configurational states for using the bed 1 consisting of the above structure are described with reference to FIG. 3 to FIG. 16.

Figure 3:
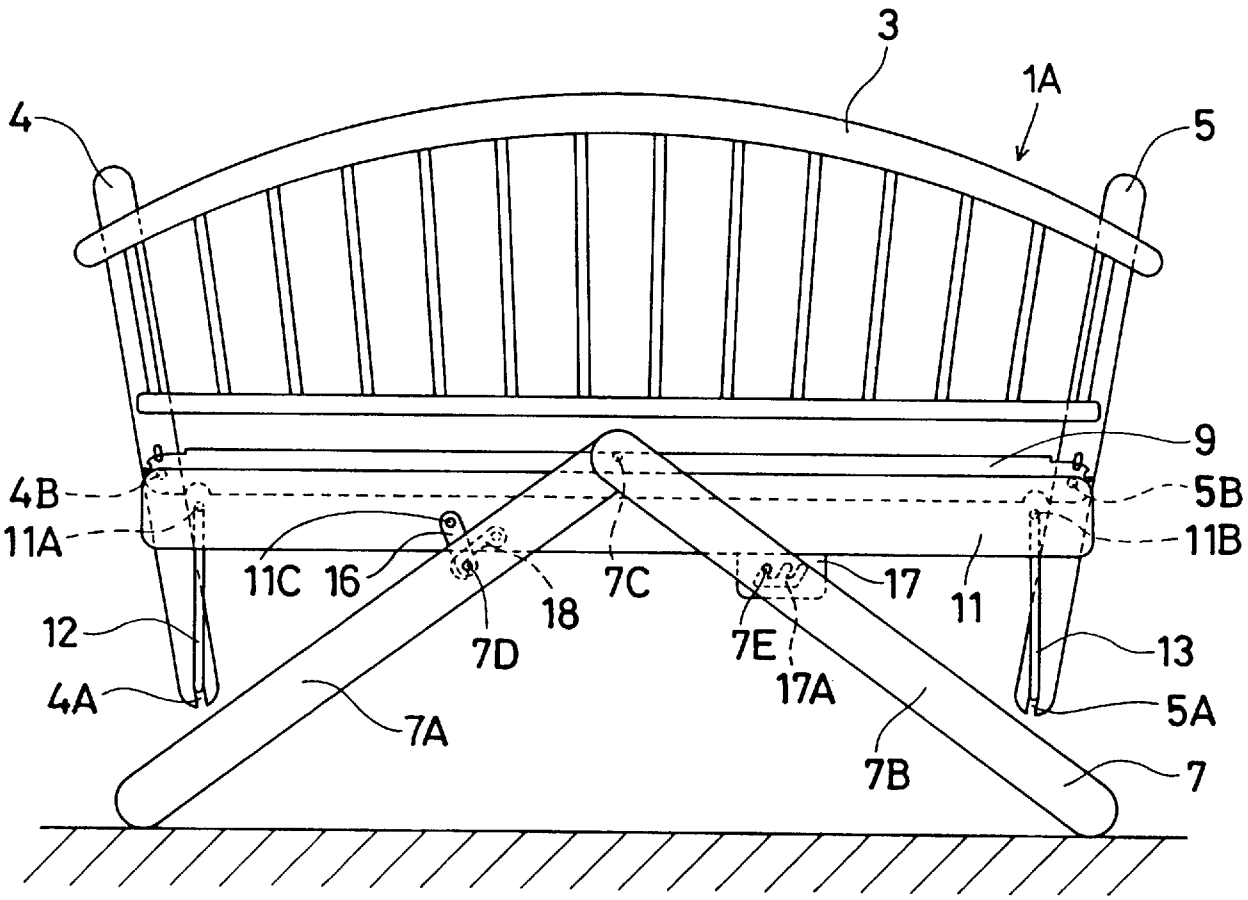
FIG. 3 is a first diagram in a view from the line A—A in FIG. 1, showing a first used state of the bed in the embodiment 1 based on the present invention.
Figure 4:
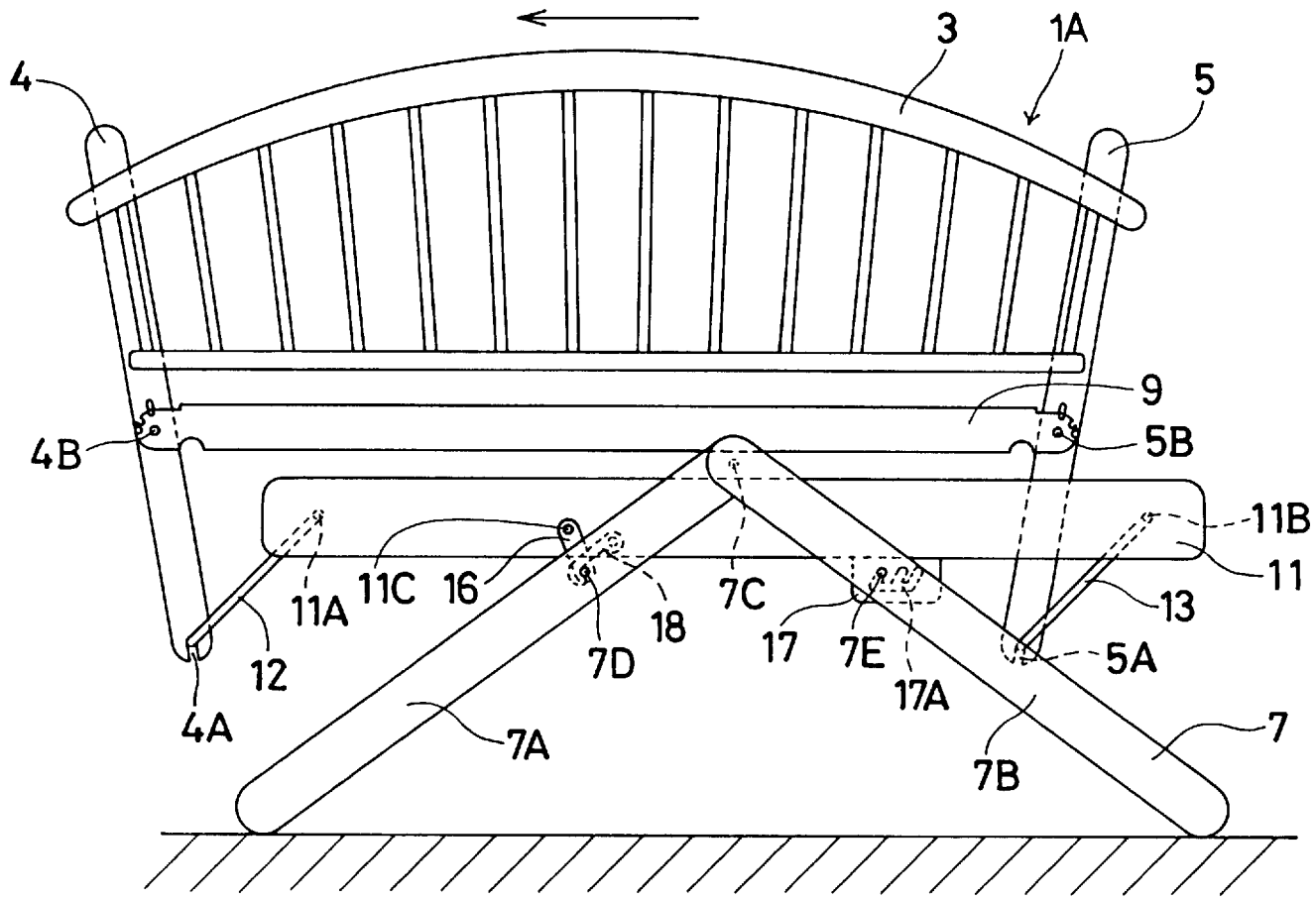
FIG. 4 is a second diagram showing the first used state of the bed in the embodiment 1 based on the present invention.

First, FIG. 3 is a diagram as viewed along the arrow of the line A—A in FIG. 1. The first base bar 10 and the second base bar 11 are set by the first leg part 6 and the second leg part 7 in the highest positions from the floor face, and the lower ends of the first panel 4 and the second panel 5 are in states floating or elevated above the floor face by a prescribed distance. Both ends of the first panel 4 and the second panel 5 are coupled with each other by protective fences 2 and 3, and/or are held in their position by lock bars 14C and 15C. Therefore, it is achieved that the bed frame body 1A consisting of the first coupling bar 8, the second coupling bar 9, the first panel 4 and the second panel 5 swings about the pivotal parts 11A and 11B by the swing shafts 12 and 13. FIG. 4 is a diagram showing a state in which the bed frame body 1A moves or swings to the left side.

Figure 5:
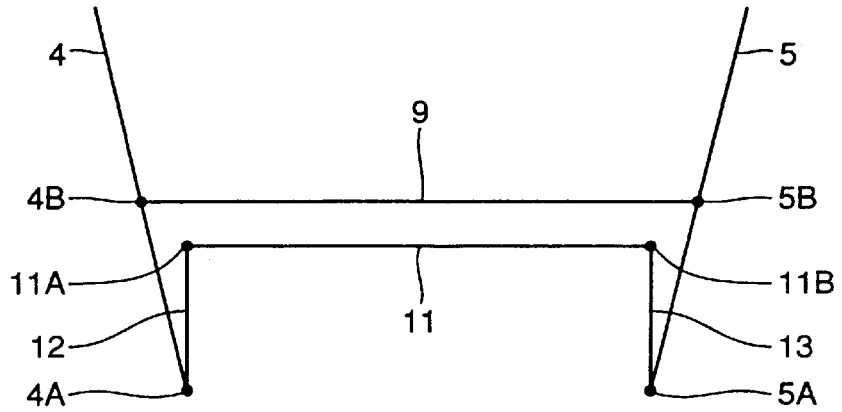
FIG. 5 is a first model diagram showing a swing state of the bed in the embodiment 1 based on the present invention.
Figure 6:
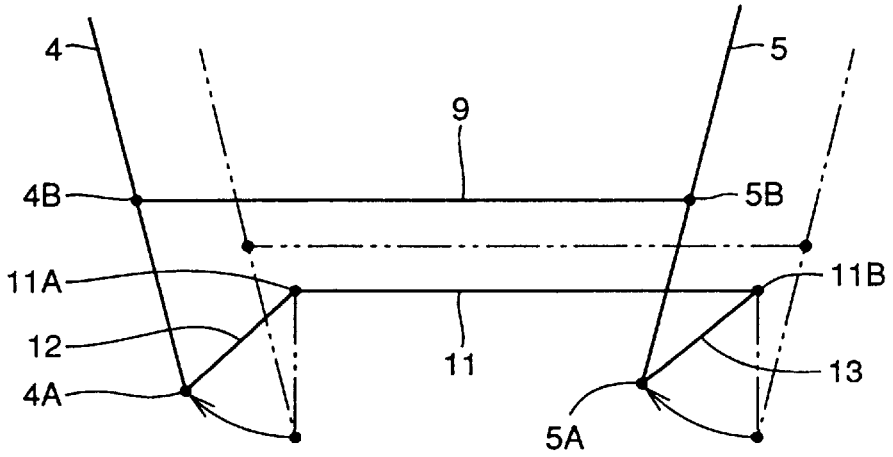
FIG. 6 is a second model diagram showing the swing state of the bed in the embodiment 1 based on the present invention.
Figure 7:
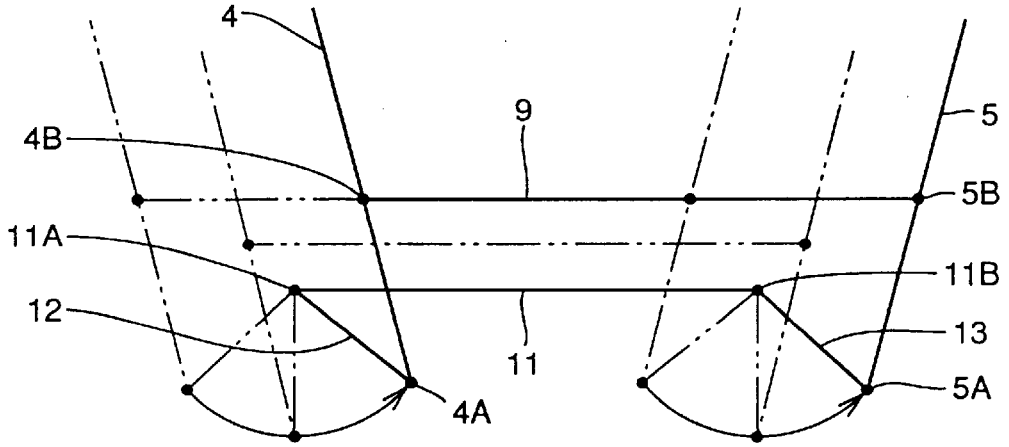
FIG. 7 is a third model diagram showing the swing state of the bed in the embodiment 1 based on the present invention.

FIG. 5 to FIG. 7 typically illustrate states of swinging of the bed frame body 1A. FIG. 5 shows the state shown in FIG. 3, FIG. 6 shows the state shown in FIG. 4, and FIG. 7 shows a state in which the bed frame body 1A moves or swings to the right side. As understood from FIG. 5 to FIG. 7, it is understood that, if the movement of only one point of the second coupling member 9 is noted, it horizontally moves and also simultaneously moves in the vertical direction. When this bed is employed as a baby bed, therefore, it is possible to provide a comforting or comfortable swinging motion for an infant.

Figure 8:
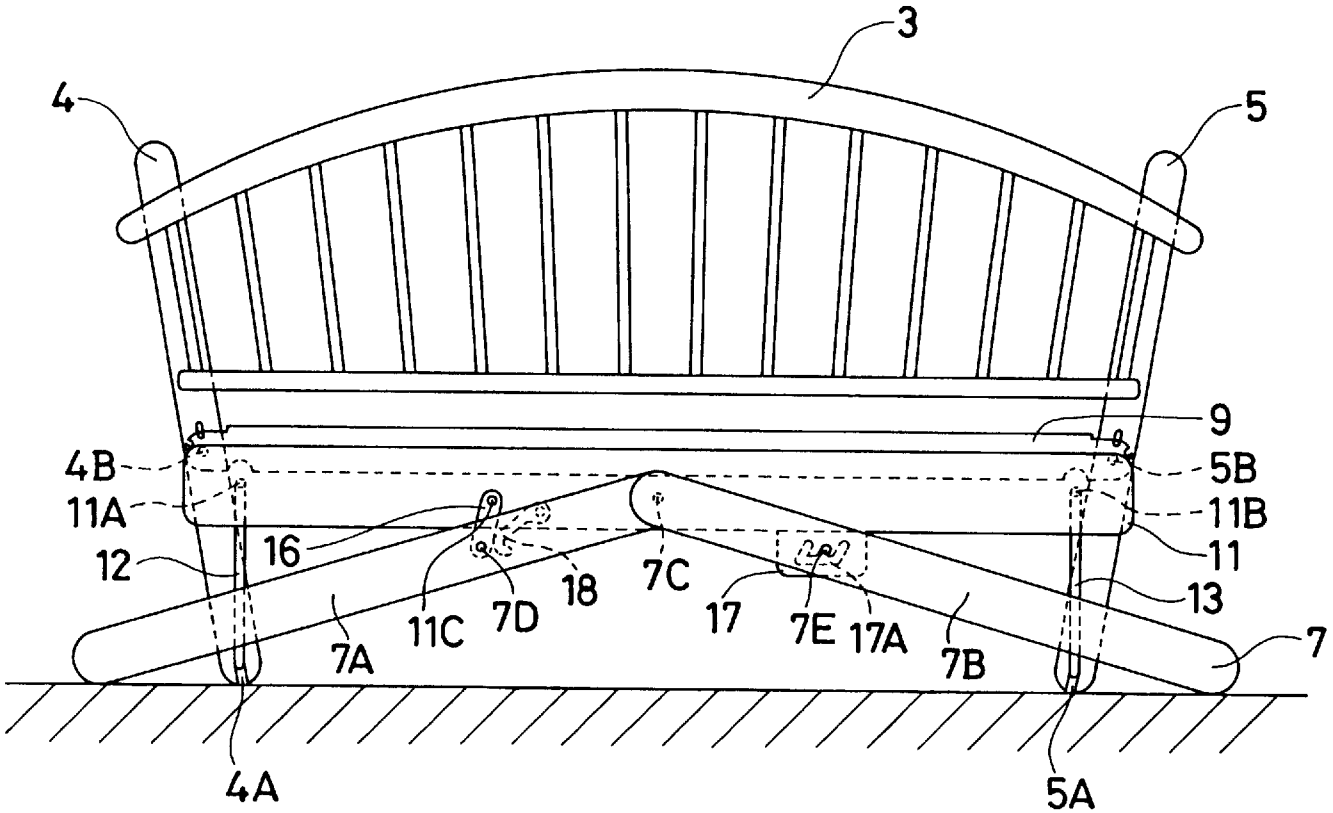
FIG. 8 is a diagram showing a second used state of the bed in the embodiment 1 based on the present invention.
Figure 9:
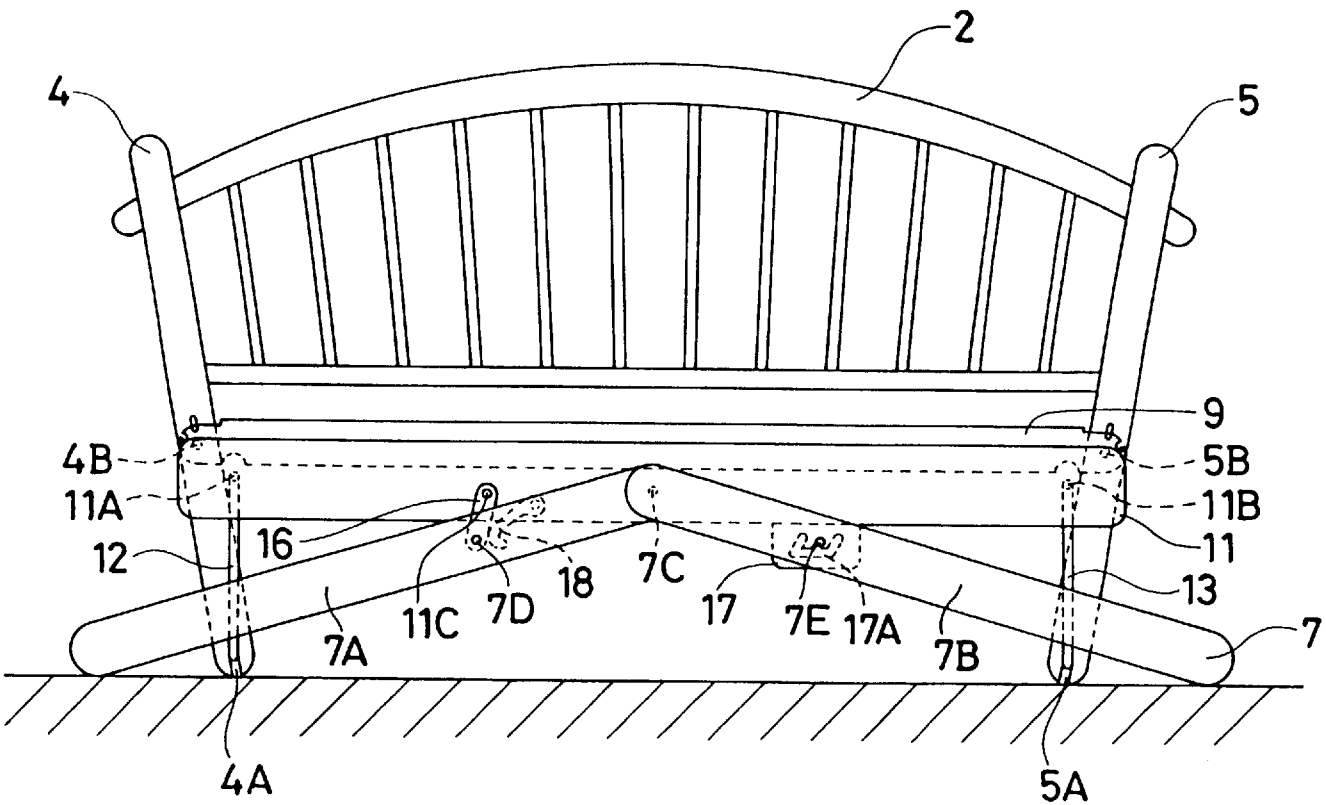
FIG. 9 is a diagram showing a third used state of the bed in the embodiment 1 based on the present invention.

Next, the state shown in FIG. 8 is adapted to bring the lower end portions of the first panel 4 and the second panel 5 into contact with the floor face by adjusting the first leg part 6 and the second leg part 7. In this state, the bed frame body 1A cannot swing in the right-left direction. Therefore, it can be employed as a playpen for an infant. Alternatively, it can be employed as a chair for an adult, by detaching one protective fence 3, as shown in FIG. 9.

Figure 10:
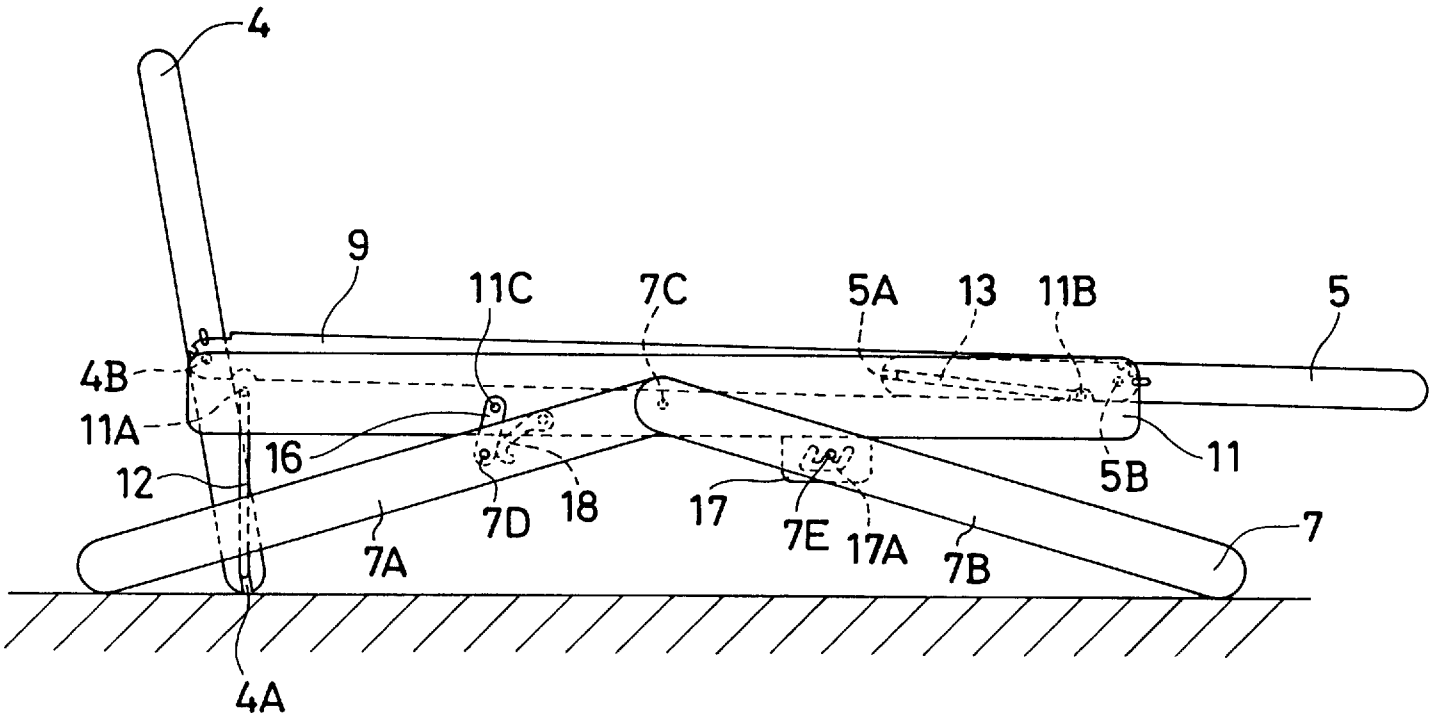
FIG. 10 is a diagram showing a fourth used state of the bed in the embodiment 1 based on the present invention.
Figure 11:
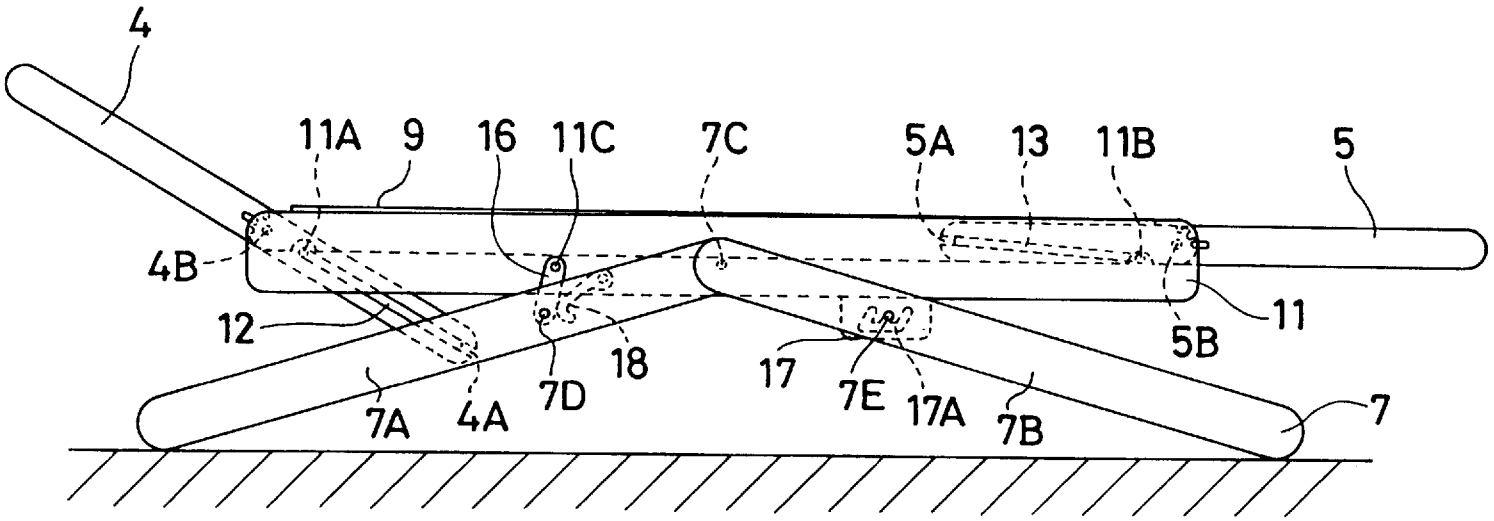
FIG. 11 is a diagram showing a fifth used state of the bed in the embodiment 1 based on the present invention.

Next, a state shown in FIG. 10 is such that only the second panel 5 is most inclined, and the bed can be employed as a bed for a child. Further, FIG. 11 shows a state of fixing the first panel 4 while it is inclined at an angle of about 45 degrees, and the bed can be employed as a bed for a junior high-school student or a senior high-school student, or a bed for reading or sunbathing in the outdoors.

Figure 12:
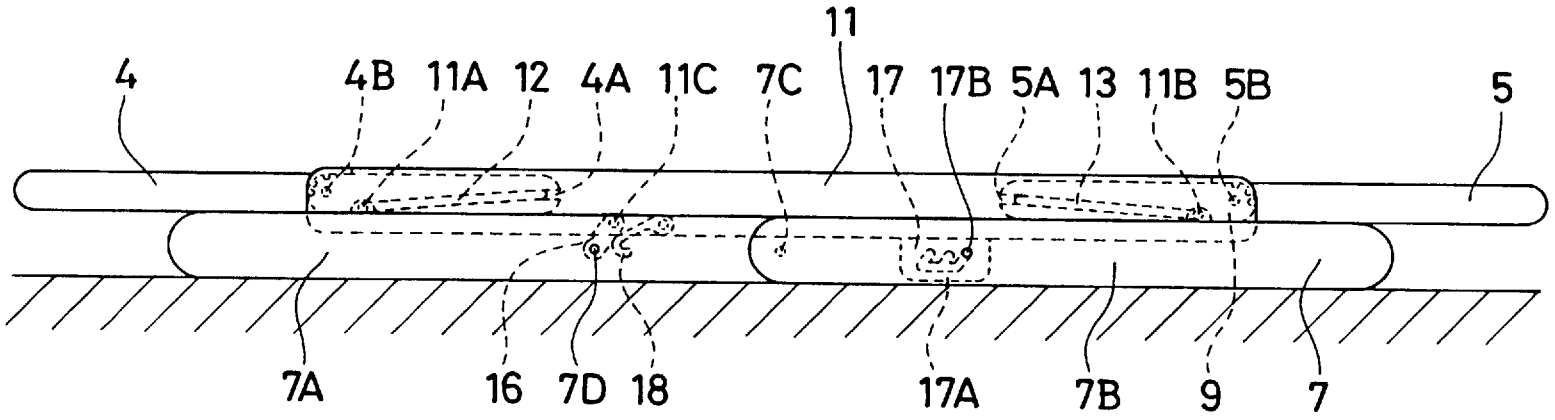
FIG. 12 is a diagram showing a sixth used state of the bed in the embodiment 1 based on the present invention.
Figure 13:
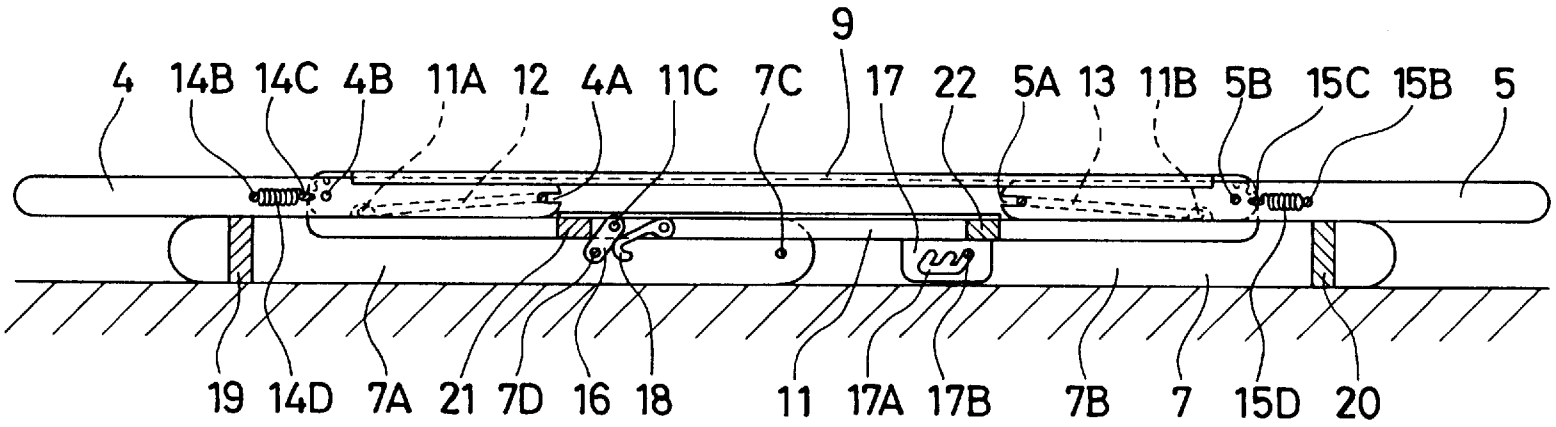
FIG. 13 is a sectional view of the state shown in FIG. 12 corresponding to a section along arrow of the line B—B in FIG. 1.

Next, FIG. 12 shows a state of bringing the first leg part 6 and the second leg part 7 into most open states, i.e. in a configuration flat on the floor, while at the same time bringing the first panel 4 and the second panel 5 into most inclined states for employing the bed as a bed for an adult. FIG. 13 is a sectional view corresponding to a section along the arrow of the line B—B in FIG. 1 in the state shown in FIG. 12.

Referring to FIG. 12 and FIG. 13, the upper surface of the first coupling member, or rail, 8 and the upper surface of the second coupling member, or rail, 9, are substantially flush with the upper surface of the first base bar 10 and the upper surface of the second base bar 11. This is in contrast to the FIG. 2 state, where the upper surface of the first coupling member 8 and the upper surface of the second coupling member 9 are positioned upward beyond the upper surface of the first base bar 10 and the upper surface of the second base bar 11 when the first panel 4 and the second panel 5 are most inclined.

Further, the lower surface of the first coupling member 8 and the lower surface of the second coupling member 9 are formed to come into contact with the upper surfaces of the base coupling bars 21 and 22, which extend between the first base bar 10 and the second base bar 11. Further, the lower surface of the first panel 4 and the lower surface of the second panel 5 are formed to come into contact with the upper surfaces of the leg part coupling bars 19 and 20 which extend between the first leg part 6 and the second leg part 7. Thus, rigidity for serving as a bed can be sufficiently maintained in the bed in the state shown in FIG. 12 and FIG. 13 for when an adult employs the same as a bed.

Figure 14:
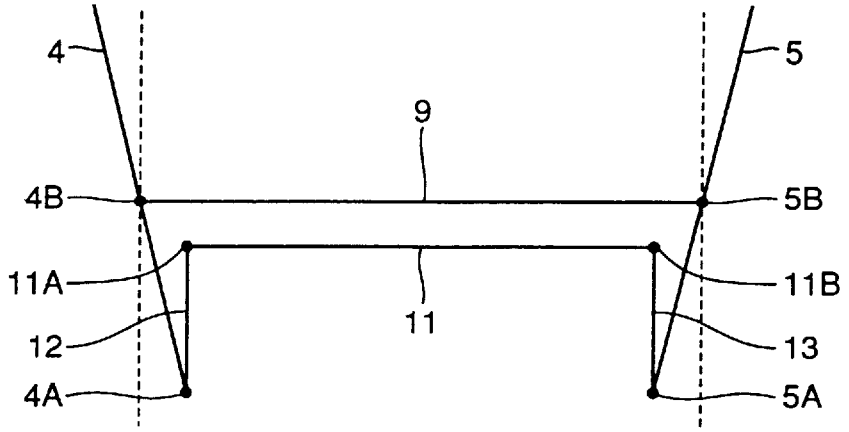
FIG. 14 is a first model diagram showing an inclining operation of the bed in the embodiment 1 based on the present invention.
Figure 15:
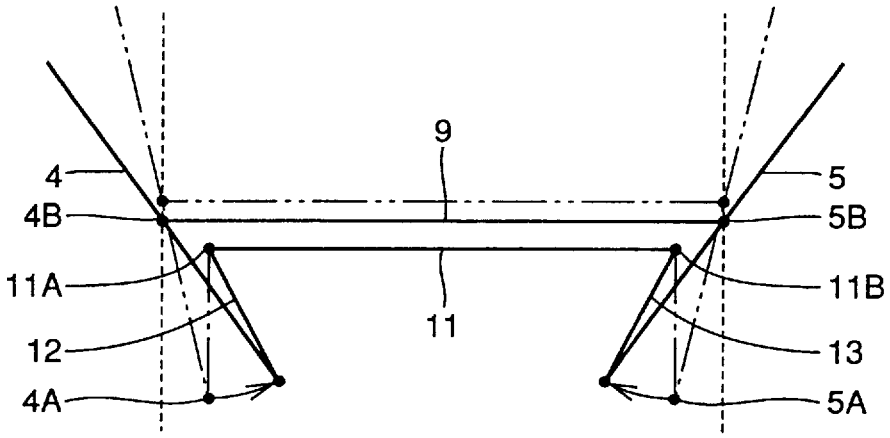
FIG. 15 is a second model diagram showing the inclining operation of the bed in the embodiment 1 based on the present invention.
Figure 16:
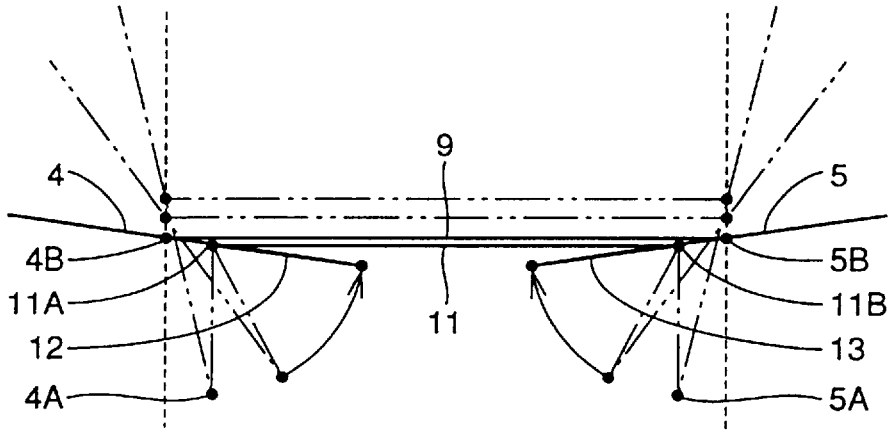
FIG. 16 is a third model diagram showing the inclining operation of the bed in the embodiment 1 based on the present invention.

With reference to FIG. 14 to FIG. 16, a state will be described in which the upper surface of the first coupling member, or rail, 8 and the upper surface of the second coupling member, or rail, 9 become substantially flush with the upper surface of the first base bar 10 and the upper surface of the second base bar 11 by inclining the first panel 4 and the second panel 5 of the bed in this embodiment. First, FIG. 14 represents the state shown in FIG. 3, in which the second coupling member, or rail 9, is positioned upward beyond the second base bar 11.

Next, with reference to FIG. 15, the first panel 4 and the second panel 5 are gradually inclined. At this time, the first panel 4 and the second panel 5 are coupled with each other by the second coupling member 9, whereby the axis parts 4B and 5B can move only downward, and the sliding parts 4A and SA rotate about the pivotal parts 11A and 11B. When the first panel 4 and the second panel 5 are further inclined, the axis parts 4B and 5B gradually move downward as shown in FIG. 16, so that the upper surface of the second base bar 11 and the upper surface of the second coupling member 9 are substantially flush with each other.

Thus, all of the upper surfaces of the bed become substantially flush with each other as shown in the state shown in FIG. 12, and it is possible to readily employ the bed as a bed for an adult by laying a mattress or the like thereon.

Figure 17:
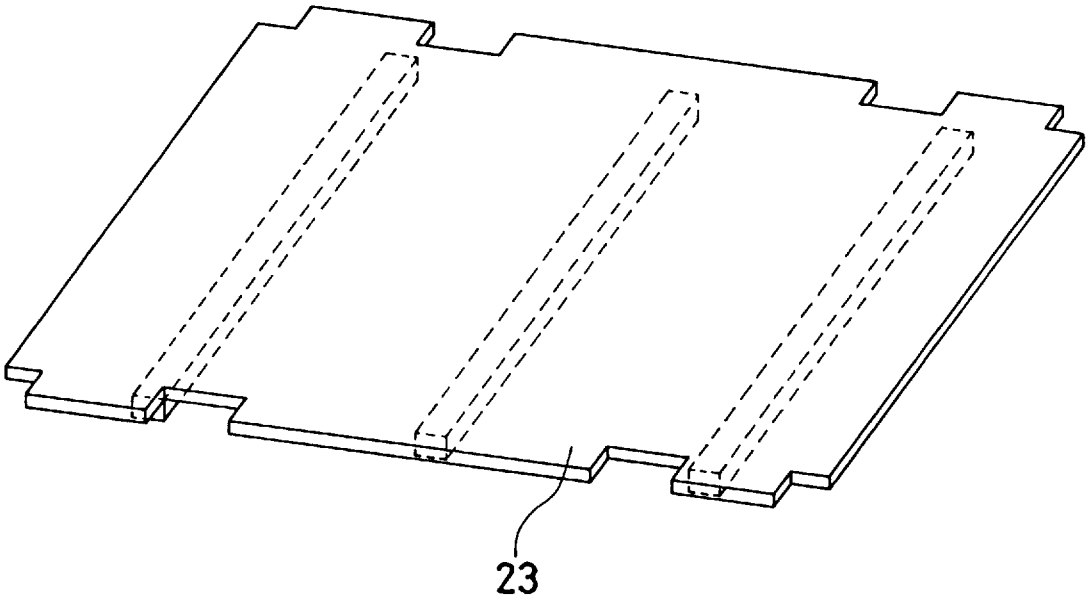
FIG. 17 is a perspective view of a plate employed for the bed in the embodiment 1 based on the present invention.

While the bed in the above embodiment has been illustrated without describing a mat or the like for convenience for illustrating its structure, it is possible to select two heights from the floor face by placing a plate 23 shown in FIG. 17 on a plane A defined by the upper surface of the first coupling member, or rail, 8 and the upper surface of the second coupling member, or rail, 9 or a plane B defined by the upper surfaces of the base coupling bars 21 and 22 and further laying a mattress or the like on this plate 23 in the state shown in FIG. 2, for example.

While the first leg part 6 and the second leg part 7 are employed as means for adjusting the heights of the first base bar 10 and the second base bar 11 from the floor face in the above embodiment, the height adjusting means is not restricted to these structures but can be readily implemented also by employing any other well-known technique.

(Embodiment 2)

Next, a bed in an embodiment 2 based on the present invention is described with reference to FIG. 18 to FIG. 22.

One of the basic ideas with respect to a bed embodying the present invention resides in a combination of adjusting the height of a bed floor and changing the form of the bed. Considering the growth process of a child, it is better that the size of the bed is smaller in the stage of an infant. In this stage, further, it is rather desirable that the height of the bed floor is higher, in order to allow the mother to readily look after the infant.

When the child grows up and gets taller, it is preferable to increase the size of the bed. In the stage that the child gets taller, mother's care or the like becomes unnecessary. Further, the child actively moves about on the bed, and hence the height of the bed floor is preferably lower, also in view of safety.

Therefore, the bed in this embodiment 2 provides a bed which makes it possible to maintain the height of the bed floor high when the size of the bed is small while lowering the height of the bed floor when the size of the bed is large.

Figure 18:
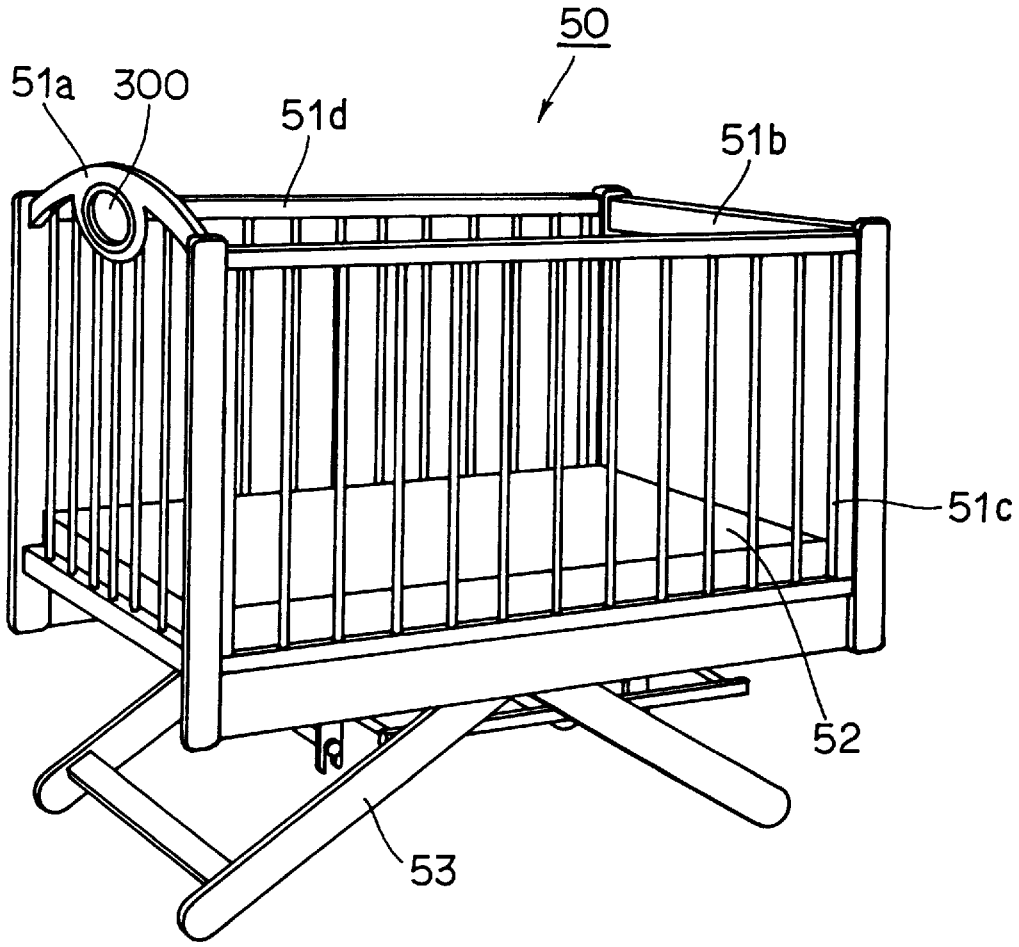
FIG. 18 is a perspective view showing the structure of a bed in an embodiment 2 based on the present invention.

First, referring to FIG. 18, a bed 50 in this embodiment 2 has a bed part 52, frame bodies 51*a* to 51*d* enclosing this bed part 52, and a leg part 53 which can adjust the height of the bed part 52 from a floor face. The state in FIG. 18 shows such a state that the bed part 52 is in the highest position from the floor face, which is a position where a mother can readily look after an infant.

Figure 19:
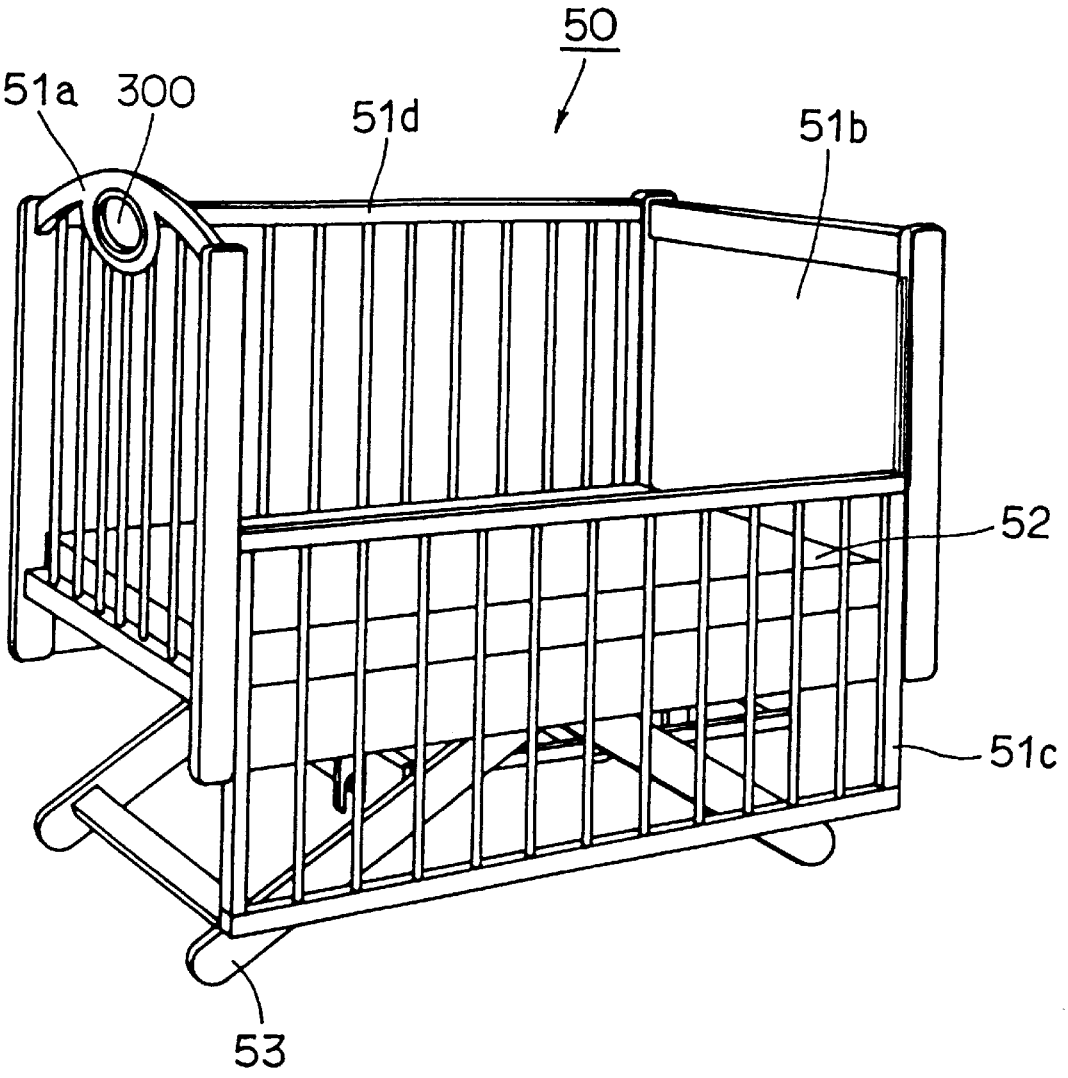
FIG. 19 is a diagram showing a first used state of the bed in the embodiment 2 based on the present invention.

Among the frame bodies 51*a* to 51*d*, the frame body 51*c* is vertically slidable along slide grooves 51*e* provided on the frame body 51*a* and the frame body 51*b*. When the mother or the like changes the diaper for the infant or holds it in her arms, therefore, the mother or the like can readily look after the infant by lowering the frame body 51*c* downward as shown in FIG. 19.

Figure 20:
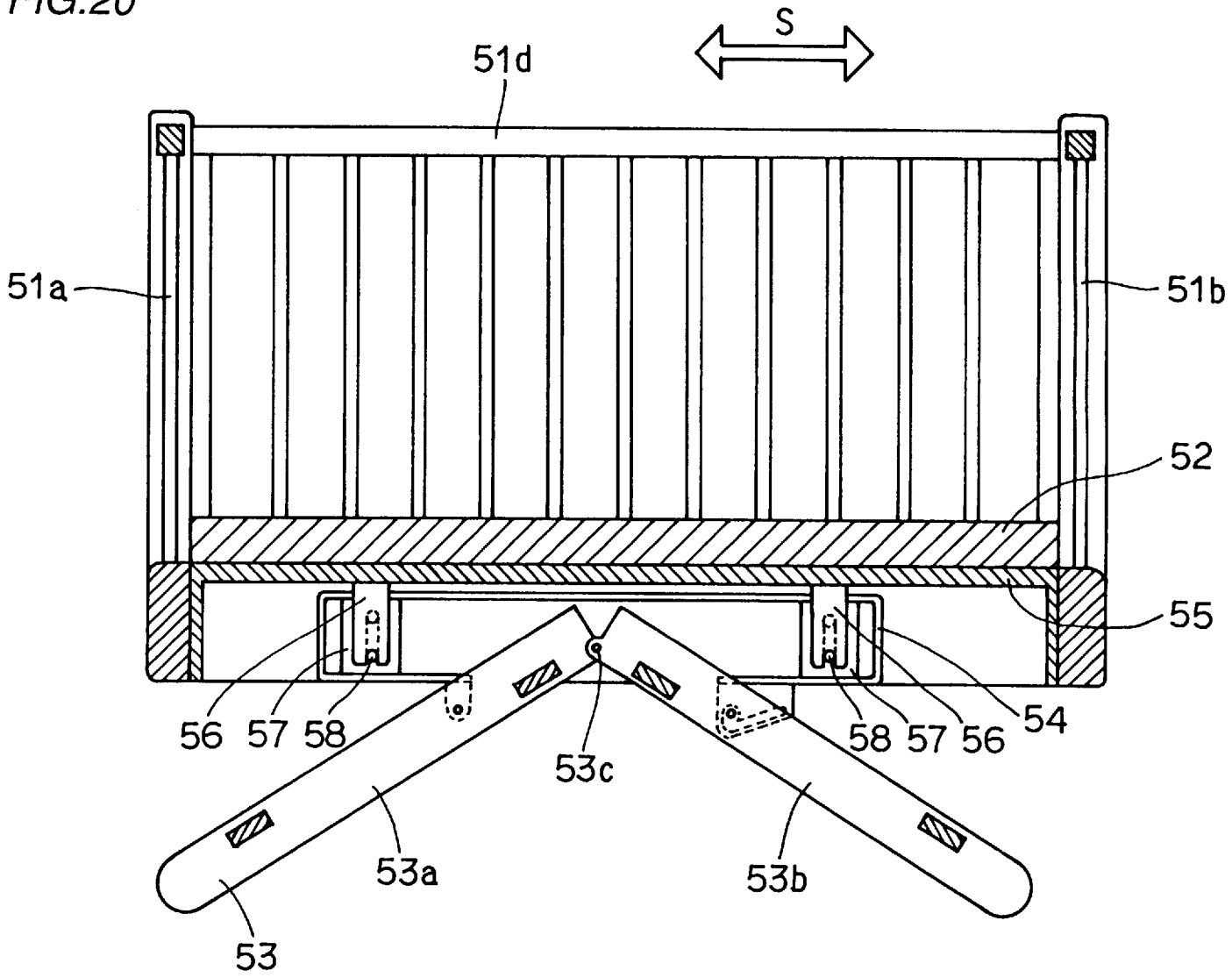
FIG. 20 is a diagram showing a sectional structure of the bed in the embodiment 2 based on the present invention.

Next, FIG. 20 is a diagram showing the sectional structure of the bed 50. The bed part 52 is mounted on a bed base 55 which is provided under the bed part 52, and the frame body 51*a* and the frame body 51*b* are mounted on the bed base 55.

Further, support plates 56 are mounted on the bed base 55, and engage with swing shafts 58 which are swingable with respect to a support base 54 provided on the leg part 53. Therefore, the bed part 52 and bed base 55 are swingable with respect to the leg part 53 in the directions of arrow shown by S in the figure. As to swinging of the bed part 52, it is also possible to stop its swinging by a stopper, or other well-known technique, although this is not shown in the figure.

The leg part 53 has a first leg part 53*a* and a second leg part 53*b* which are bent or articulated to each other in an inverted V shape about a pivotal point 53*c* provided at the central portion, and the height of the bed part 52 from the floor face is lowered by increasing an angle formed by leg parts 53*a* and 53*b*. Further, it is possible to bring the bed part 52 to the lowest position as shown in FIG. 21 by making the first leg part 53*a* and the second leg part 53 extend substantially at 180 degrees to be along the floor face in a parallel manner.

Figure 21:
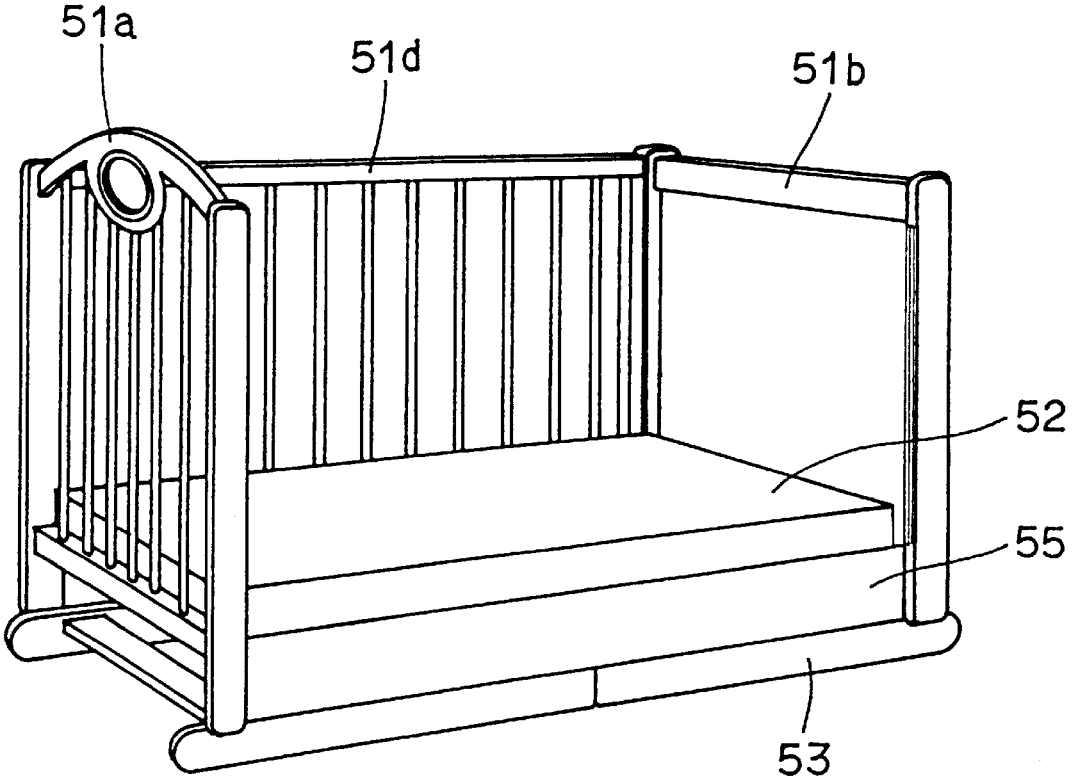
FIG. 21 is a diagram showing a second used state of the bed in the embodiment 2 based on the present invention.

While illustration is made as to a state of detaching the frame body 51*c* as shown in FIG. 21, the bed can be employed as a playpen for an infant by mounting the frame body 51*c*. In the state detaching the frame body 51*c* as illustrated, the bed can also be employed as a sofa.

Figure 22:
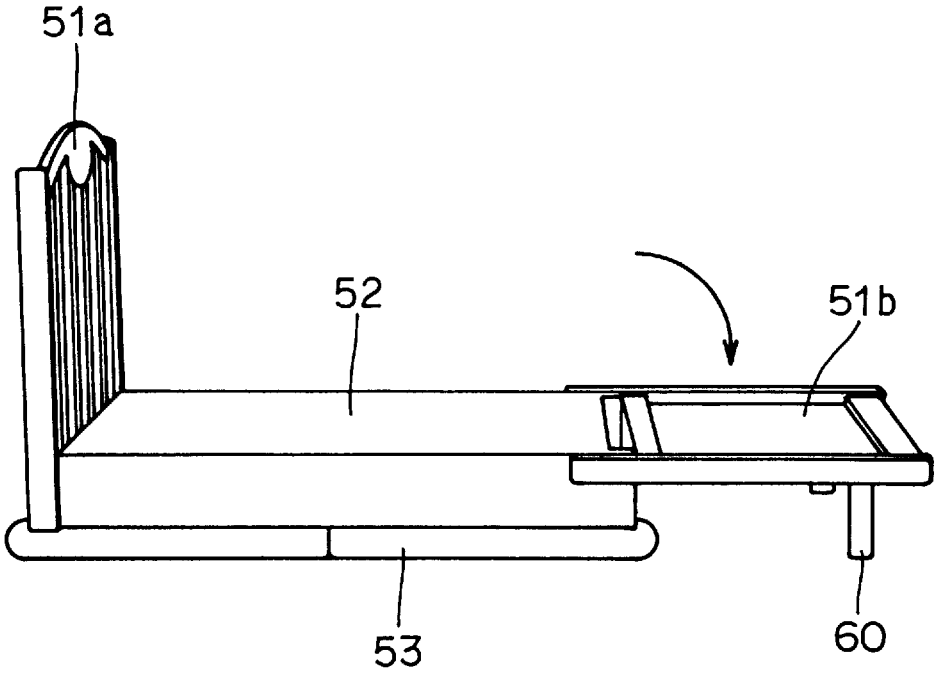
FIG. 22 is a diagram showing a third used state of the bed in the embodiment 2 based on the present invention.

In the bed 50 in this embodiment 2, further, the frame body 51*b* is rotatably mounted by a well-known technique with respect to the bed part 52, and it is possible to enlarge the area of the bed part by detaching the frame body 51*c* and the frame body 51*d* and raising an auxiliary leg 60 provided on the frame body 51*b*, as shown in FIG. 22.

It can be seen that in the bed 50 in the above embodiment 2, therefore, it is possible to provide a bed for an infant which can change the length or the form of the bed part to respond to growth of the infant and change of the living environment.

When based on the aforementioned basic idea, the bed frame body may not necessarily be swingably provided.

The change of the form of the bed frame body itself may be either the embodiment 1 or the embodiment 2.

As still another embodiment, the height of the bed frame body may be fixed. In this case, the bed comprises a bed frame body enclosing four perimeter sides of a bed floor with a frame, and a bed support swingably supporting this bed frame body in a state floating or suspended above the floor face. The bed support swingably supports the bed frame body along its length direction (i.e. the direction extending from the head to the legs of the baby).

In the bed shown in FIG. 1, for example, the bed frame body is swingable and the area of a portion of the bed forming a bed floor changes by the fact that the form of the bed frame body changes, while the height of the bed frame body is adjustable. In order to implement such functions, the bed includes three portions as a basic structure. Namely, the bed comprises the bed frame body 4, 5, 8 and 9, the base bars 10 and 11 swingably supporting the bed frame body, and the leg parts 6 and 7 height-controllably supporting the base bars. If the height of the bed frame body is fixed and the bed frame body is simply swingably supported, the base bars 10 and 11 and the leg parts 6 and 7 may be fixed. If only the combination of change of the form of the bed frame body and the height of the bed floor is to be implemented, without the structures that allow the swinging of the bed frame body, the base bars 10 and 11 and the bed frame body may be fixed.

(Example 3)

The applicant's idea on rearing of an infant is briefly mentioned here.

According to "Ikuji No Genri: by Jushichiro Naito (published by Aprica Ikuji Kenkyukai)", it is described that not only the body or the form but all aspects such as the character and sociability are included in growth of a human, and "mother-child interactions" are extremely important particularly for a baby in its infancy.

In these "mother-child interactions", there are (1) "interaction by the sense of touch" based on physical contact between the mother (father) and the baby,
(2) "interaction by the sense of sight" based on eye contact between the mother (father) and the baby,
(3) "interaction by the sense of hearing" of verbal talking from the mother (father) to the baby and a cry from the baby to the mother (father),
(4) "interaction by the sense of smell" based on the body odor of the mother and milky smell of the baby, and
(5) "interaction by the sense of taste" based on mother's milk.

These "mother-child interactions" are not independently carried out respectively, but naturally performed through the gentle and stable mother's skin in the ordinary child rearing of carrying the baby in her arms or on her back, breast-feeding it or taking a walk with it.

Thus, it is assumed that fertile human relations result between the parents and the child by making bonds between the mother and the child and between the father and the child from the infanthood, and if child rearing is carried out so as to establish and maintain such bonds, then the child develops the characteristics of fertile humanity such as love, friendship and confidence, and further can firmly develop "fundamental confidence" forming the nucleus of human relations in the future life.

However, the aforementioned love from the parents to the child and the bonds between the parents and the child are intangible. Therefore, the parents insert the child's photograph in a photo stand and display the same, form a photo album as a record of the child's growth, or make a message card, in order to transform the parents' deep emotion at the birth of the child, and the intangible love such as the affection and bonds from the parents to the child into a tangible.

Also in the daily life, there are things into which the love from the parents to the child etc. is transformed. Into a bed for an infant, for example, the parents' love to the child and the bonds are naturally transformed. However, this bed for an infant falls into disuse as the child grows up. Even in the bed for an infant into which the love and the bonds are specially transformed, therefore, the child cannot sometimes take a look at it to touch the parents' love given to him in his infanthood and the bonds with the parents when the child grows up.

Therefore, it is significant to provide a bed that can be employed for a long time by a person growing from a newborn baby to an adult, if the bed is designed from the first so that it can be used also when a child grows up into an adult. Further, it is conceivable that the child can grow while always feeling the parents' love and the bonds with the parents by placing the aforementioned photograph or message card near this bed for an infant. In particular, it is extremely important to grow up while feeling the parents' love and the bonds with the parents in the periods of zero to three years old and zero to six years old for forming the basis of the personality, before reaching the sensitive period of 10 years old to 15 years old.

However the photo album is not always looked at but generally put on a bookshelf or the like, and hence the parents' love and the bonds with the parents cannot be felt daily. On the other hand, if the photograph is inserted in a photo frame or the like and displayed in a regularly visible state, the photograph becomes so familiar that the child feels nothing in fact, and its effect becomes a relatively shallow or insignificant one.

In the present inventive embodiment 3, therefore, a bed from which the parents' love, the bonds with the parents and the like can be properly perceived in the child's growth period is described.

A bed 50 for an infant in the embodiment 3 based on the present invention is hereafter described with reference to FIG. 23 through FIG. 30.

First, an outline of the structure of this bed 50 for an infant is described with reference to FIG. 23. This bed 50 for an infant comprises a bed part 52 on which an infant sleeps, and frame bodies 51*a* to 51*d* enclosing the bed part 52.

A rectangular opening 3*a* is provided on the frame body 51*b*, and a vertically rotatable frame 100 is mounted on this opening 3*a* in a rotation direction shown at arrow A in the figure. This bed 50 for an infant has a variable mechanism capable of changing the length of the bed part 52 by employing a well-known technique following growth of the infant into an adult, as shown in FIG. 22 of the embodiment 2. While the frame 100 is shown in a state mounted on the frame body 51*b*, frame 100 may be mounted on any one of the frame bodies 51*a* to 51*d*.

With reference to FIG. 24 to FIG. 30, the detailed structure of the frame 100 is described.

Figure 23:
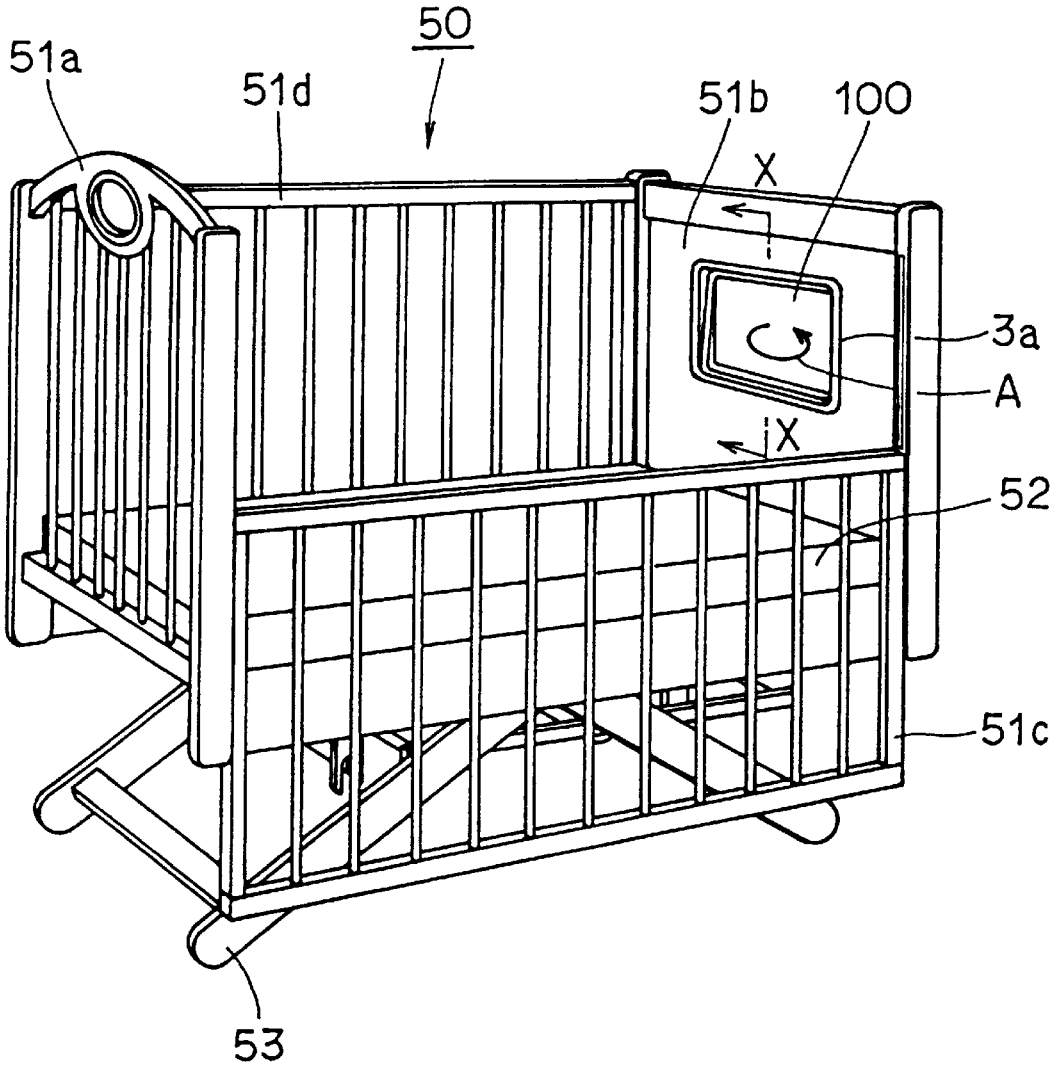
FIG. 23 is a diagram showing a fourth used state of the bed in the embodiment 2 based on the present invention.
Figure 24:
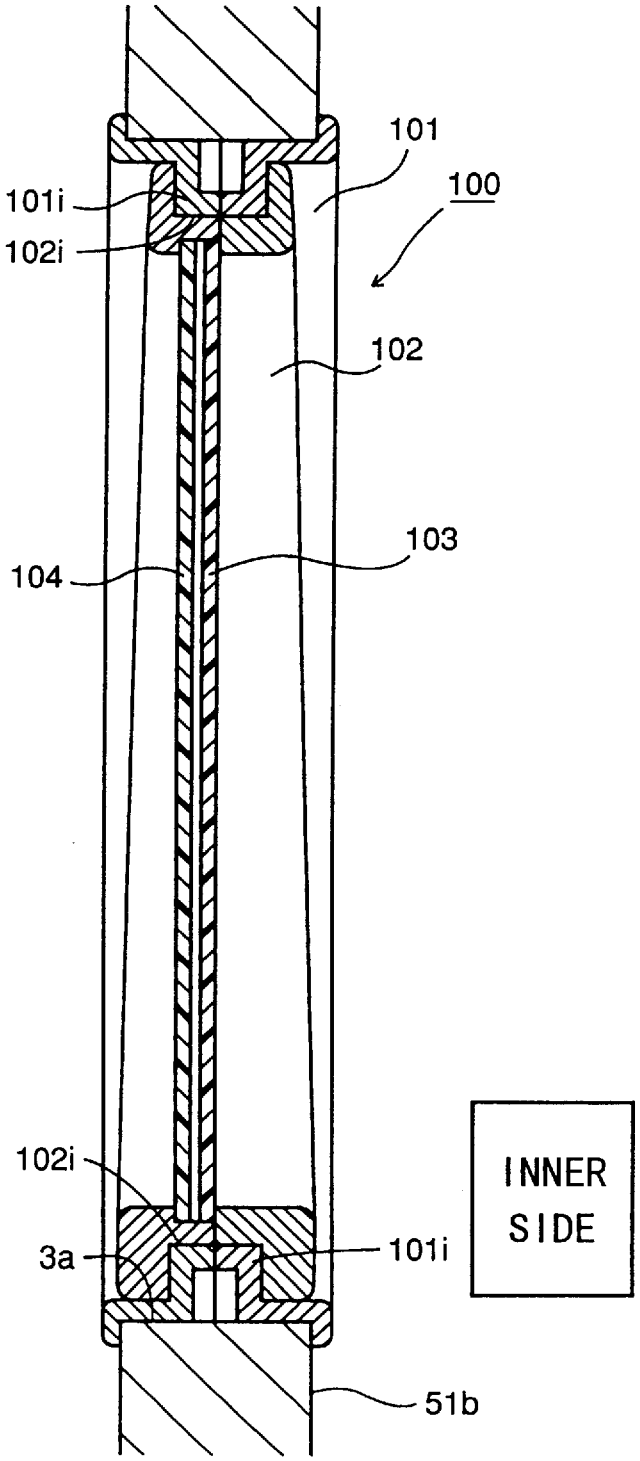
FIG. 24 is a sectional view as viewed along arrow of the line X—X in FIG. 23.

First, FIG. 24 is a diagram showing the sectional structure of the frame 100 in accordance with a section as viewed along arrow of the line X—X in FIG. 23. Inner frame 102 is vertically rotatably mounted on an outer frame 101 which is provided to cover an inner peripheral surface of an opening 3*a* of the frame body 51*b*. The frame 100 has two transparent plates 103 and 104 for holding a photograph or a message card in the interior.

A pair of rotation axes 101*i* of cylindrical forms are provided on the central portion of an upper side and the central portion of a lower side of the outer frame 101, and these rotation axes 101*i* are inserted in/pivotally supported by a pair of bearing parts 102*i* provided on the central portion of an upper side and the central portion of a lower side of the inner frame 102, whereby the inner frame 102 becomes vertically rotatable with respect to the outer frame 101.

Figure 25:
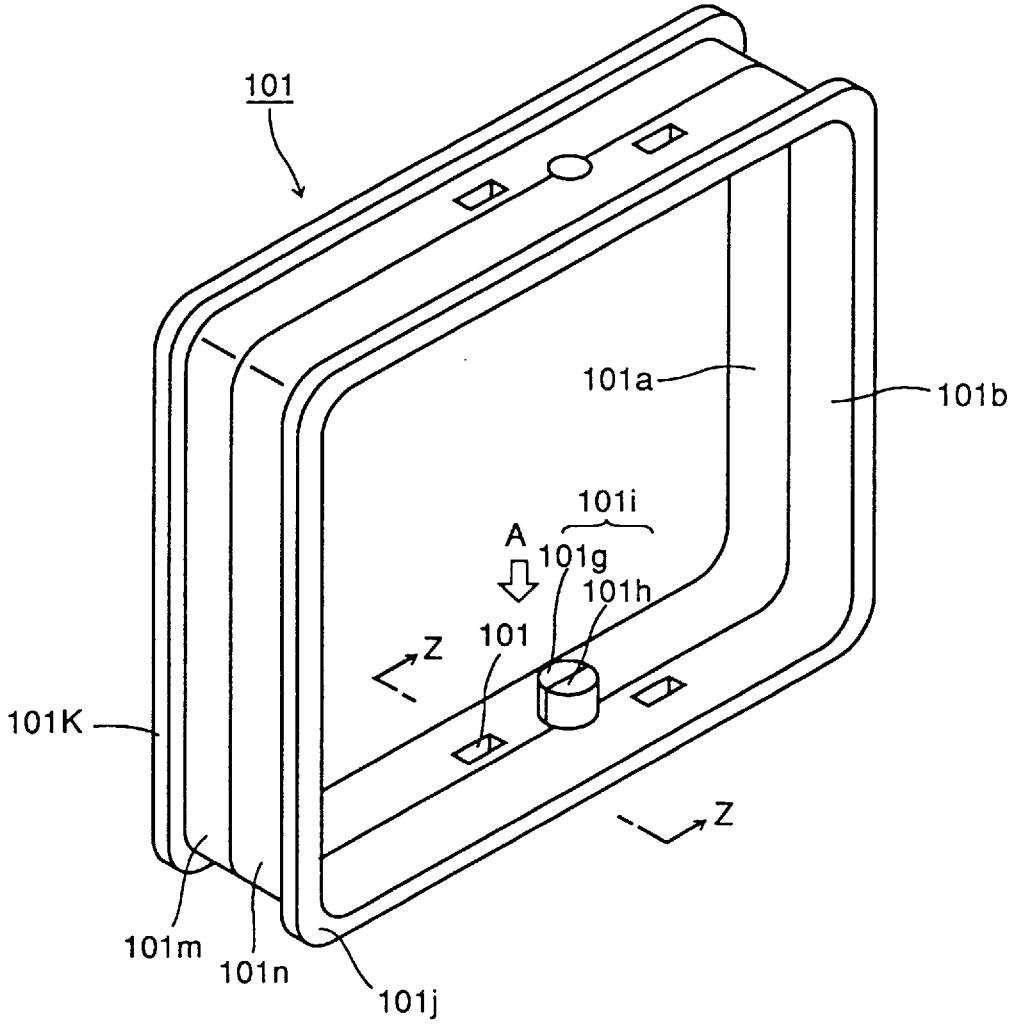
FIG. 25 is a general perspective view of an outer frame in an embodiment 3.
Figure 26:
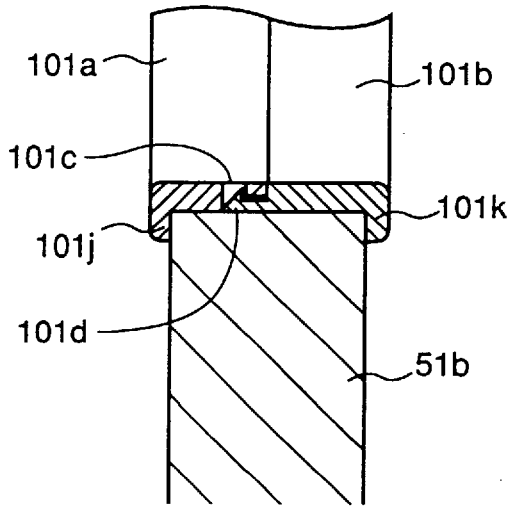
FIG. 26 is a sectional view as viewed along arrow of the line Z—Z in FIG. 25.

Next, the structure of the outer frame 101 is described with reference to FIG. 25 to FIG. 27. FIG. 25 is a general perspective view of the outer frame 101, FIG. 26 is a sectional view as viewed along arrow of the line Z—Z in FIG. 25, and FIG. 27 is a detail view of a part as viewed along arrow A in FIG. 25.

The outer frame 101 has a first outer frame 101*a* and a second outer frame 101*b* divided into two to approach and hold the opening 3*a* of the frame body 51*b* from both sides. Both of this first outer frame 101*a* and the second outer frame 101*b* have the same shapes.

Both of the first outer frame 101*a* and the second outer frame 101*b* have guide frame parts 101*m* and 101*n* along the inner peripheral surface of the opening 3*a*, and further have flange parts 101*j* and 101*k* extending in directions outwardly intersecting with respect to the guide frame parts 101*m* and 101*n* from first end sides of the guide frame parts 101*m* and 101*n*.

Figure 27:
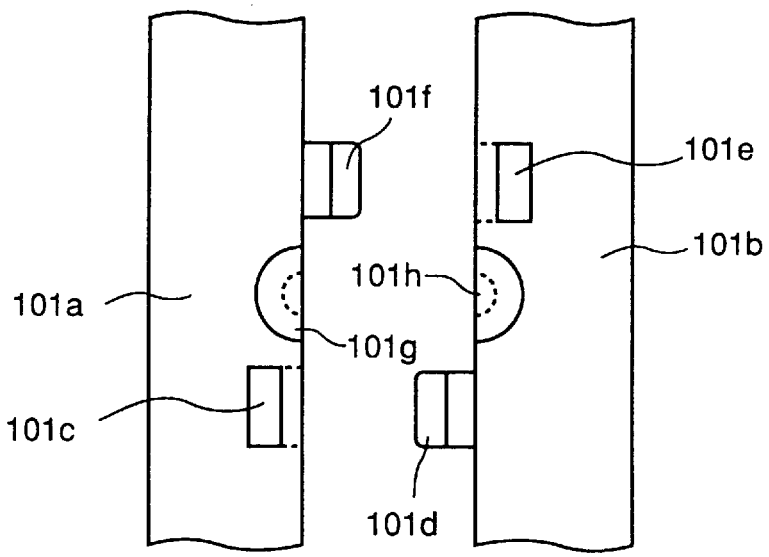
FIG. 27 is an enlarged view of a part as viewed along arrow A in FIG. 25.

As shown in FIG. 27, further, the respective ones of the first outer frame 101*a* and the second outer frame 101*b* have a semi-cylindrical pair of projection forming members 101*g* and 101*h* on opposite sides of the flange parts 101*j* and 101*k* on the central portions of the upper sides and the central portions of the lower sides, and further have engaging holes 101*c* and 101*e* and engaging pawls 101*f* and 101*d* in the guide frame parts 101*m* and 101*n*, to hold these projection forming members 101*g* and 101*h*.

In a state of mounting the first outer frame 101*a* and the second outer frame 101*b* on the opening 3*a* of the frame body 51*b*, therefore, it is achieved that a peripheral edge portion of the opening is held by the flange parts 101*j* and 101*k* which are provided on the respective ones of the first outer frame 101*a* and the second outer frame 101*b*, and the outer frame 101*a*, 101*b* itself is fixed to the peripheral edge portion of the opening 3*a*.

Further, the semicylindrical projection forming members 101*h* and 101*g* meet with each other as shown in FIG. 25, to form a rotation axis 101*i*. Further, the engaging holes 101*c* and 101*e* of the first outer frame 101*a* and the second outer frame 101*b* and the engaging pawls 101*d* and 101*f* engage with each other respectively as shown in FIG. 26, whereby the first outer frame 101*a* and the second outer frame 101*b* are coupled with each other.

Figure 28:
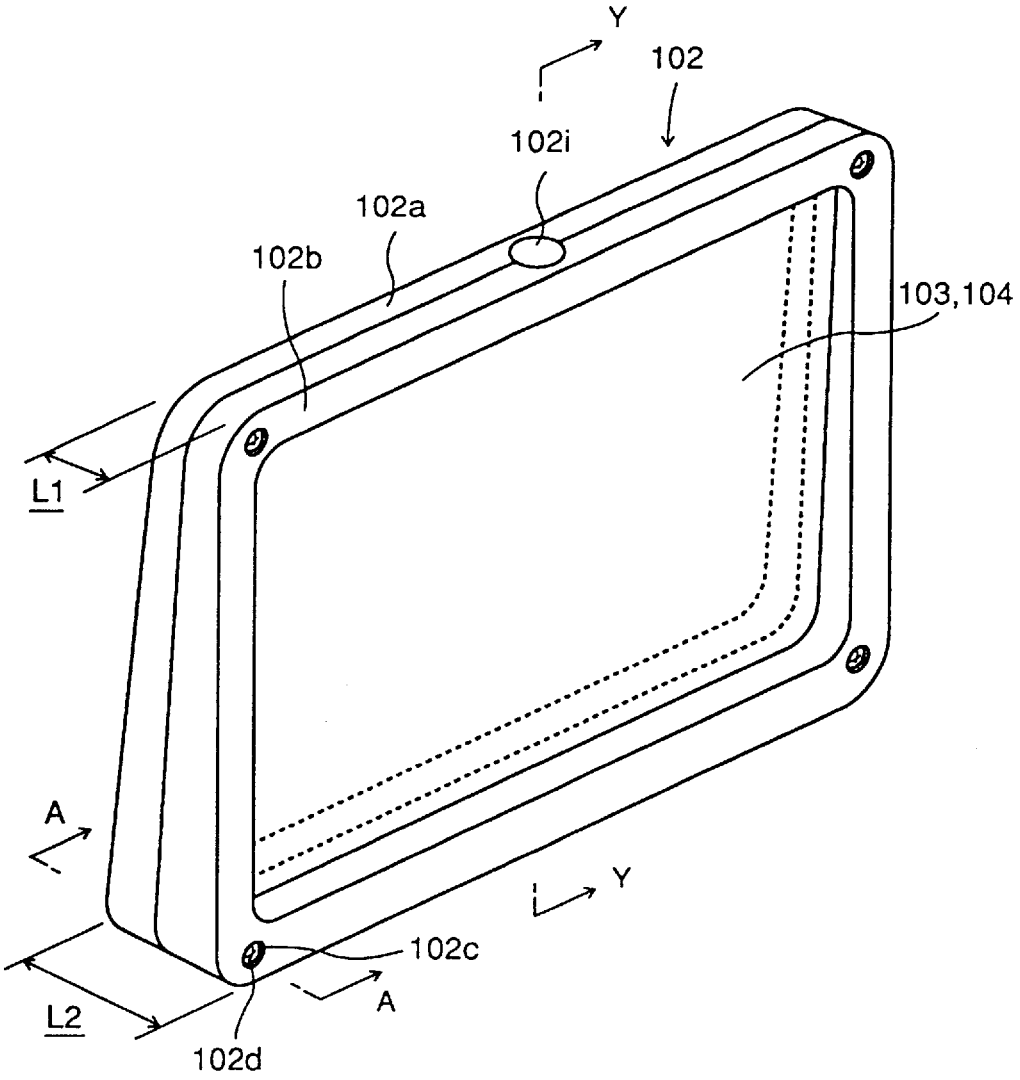
FIG. 28 is a general perspective view of an inner frame in the embodiment 3.

Next, the structure of the inner frame 102 is described with reference to FIG. 28 to FIG. 30. FIG. 28 is a general perspective view of the inner frame 102, FIG. 29 is an end view as viewed along arrow of the line Y—Y in FIG. 28, and FIG. 30 is a sectional view of a part as viewed along arrow of the line A—A in FIG. 28.

The inner frame 102 has two transparent plates 103 and 104 consisting of substantially rectangular acrylic plates or the like holding a photograph or a message card therebetween, as shown in FIG. 28. Peripheral edge portions of these two transparent plates are held by a first inner frame 102*a* and a second inner frame 102*b*.

Figure 29:
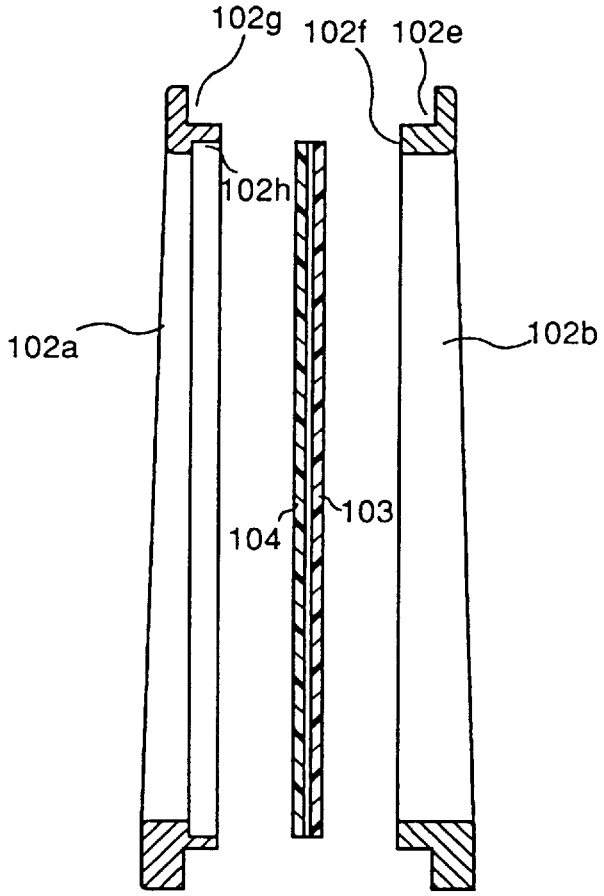
FIG. 29 is an exploded sectional end view as viewed along arrow of the line Y—Y in FIG. 28.
Figure 30:
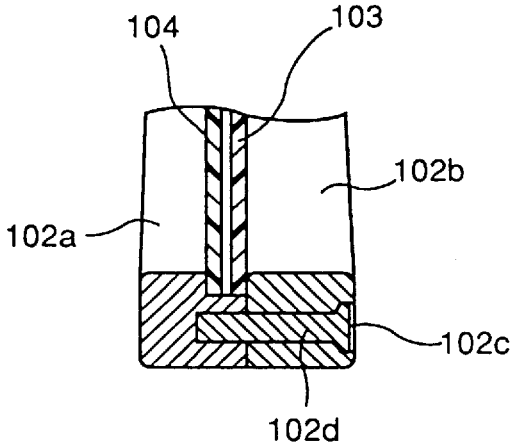
FIG. 30 is a sectional view of a part as viewed along arrow of the line A—A in FIG. 28.

On a position of the first inner frame 102*a* holding the peripheral edge portions of the transparent plates 103 and 104, a notched part 102*h* storing or receiving the peripheral edge parts of the transparent plates 103 and 104 is provided on the overall periphery, as shown in FIG. 29. On a peripheral edge portion of the second inner frame 102*b*, on the other hand, a contact surface 102*f* coming into contact with the peripheral edge portions of the transparent plates 103 and 104 stored or received in the first inner frame 102*a* is provided in order to hold the transparent plates 103 and 104 into the first inner frame 102*a*.

As shown in FIG. 28 and FIG. 29, semicylindrical groove holes 102*e* and 102*g* are provided for forming a bearing 102*i* in the central portion of the upper side and the central portion of the lower side of the inner frame 102 when the first inner frame 102*a* and the second inner frame 102*b* are overlapped with each other.

Further, screw holes 102*c* for overlapping and coupling the first inner frame 102*a* and the second inner frame 102*b* with each other are provided on four corners of the first inner frame 102*a* and the second inner frame 102*b*, and coupled by screws 102*d*, as shown in FIG. 30.

In the frame 100 consisting of the aforementioned structure, a character cartoon or the like is inserted in a surface on the infant side and a message card showing the parents' affection for the child or a photograph taken when the child was born is inserted in the surface of the opposite side, for example.

Thereby, the child can always see the character cartoon or the like in its the daily life, whereby a pleasant feeling can be given to the child.

Further, the child can perceive the parents' love for him by rotating the inner frame 102 sometimes. Particularly in the sensitive period of 10 years old to 15 years old, it is possible to effectively remind the child's heart of the parents' love and the bonds with the parents, and thus develop a docile or contented heart, by perceiving the parents' love sometimes in such a manner. While the inner frame 102 is rendered vertically rotatable with respect to the outer frames 101*a*, 101*b*, transverse rotation may alternatively be employed.

As shown in FIG. 28, it is possible to detach the inner frames from the bed and make them self-sustained on a desk or the like also when the bed cannot be used, by providing widths ($L_2$) of lower sides longer than widths ($L_1$) of upper sides of the inner frames.

Also by this, attachment to the bed used from the infanthood or the like is transformed into the inner frames, while it is possible to reconfirm the parents' love and the bonds with the parents and build up fertile humanity at the same time.

(Embodiment 4)

An embodiment 4 based on the present invention is now described with reference to FIG. 31 to FIG. 35.

While the structure of inserting the frame in the opening 3*a* provided in the frame body 51*b* and vertically rotating the frame has been employed in the bed for an infant in the aforementioned embodiment 3, a frame is inserted in and mounted on a groove part provided in a headboard 51*b* in this embodiment 4.

Figure 31:
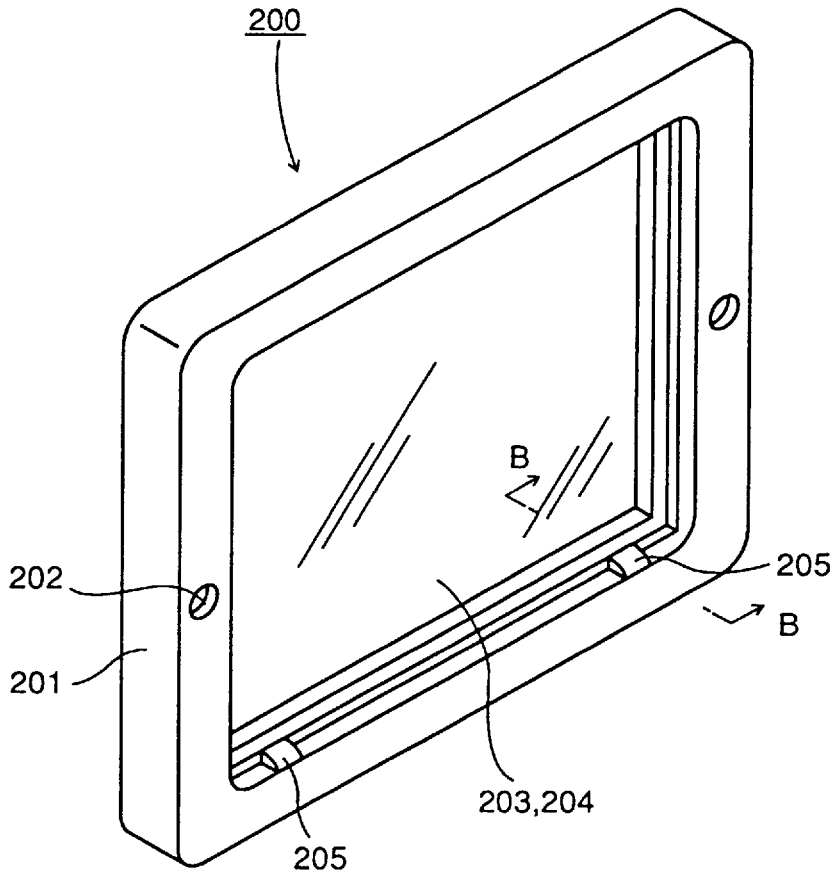
FIG. 31 is a general perspective view of a frame in an embodiment 4.

First, the structure of a frame 200 in this embodiment 4 is described with reference to FIG. 31 and FIG. 32. FIG. 31 is a general perspective view of the frame 200, and FIG. 32 is a sectional view along an arrow of the line B—B in FIG. 31.

This frame 200 has two transparent plates 203 and 204 consisting of acrylic plates or the like for holding a photograph or the like therebetween, and has an inner frame 201 enclosing peripheral edge portions of these two transparent plates 203 and 204 and supporting an outer peripheral portion of the transparent plate 204, as shown in FIG. 31.

Figure 32:
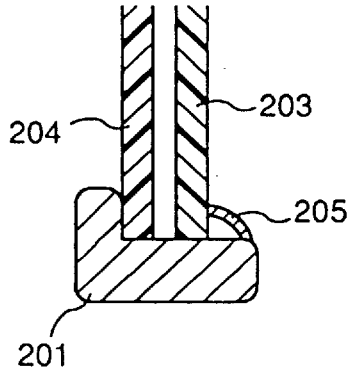
FIG. 32 is a sectional view of a part as viewed along arrow of the line B—B in FIG. 31.

On the transparent plate 203 side of the inner frame 201, elastic members 205, as shown in FIG. 32, for urging the transparent plate 203 toward the transparent plate 204 and fixing the transparent plates 203 and 204 are provided in plural, as shown in FIG. 31 and FIG. 32. Further, a mounting hole 202 for fixation to a headboard 51*b* is provided on a side portion of the inner frame 201.

Figure 33:
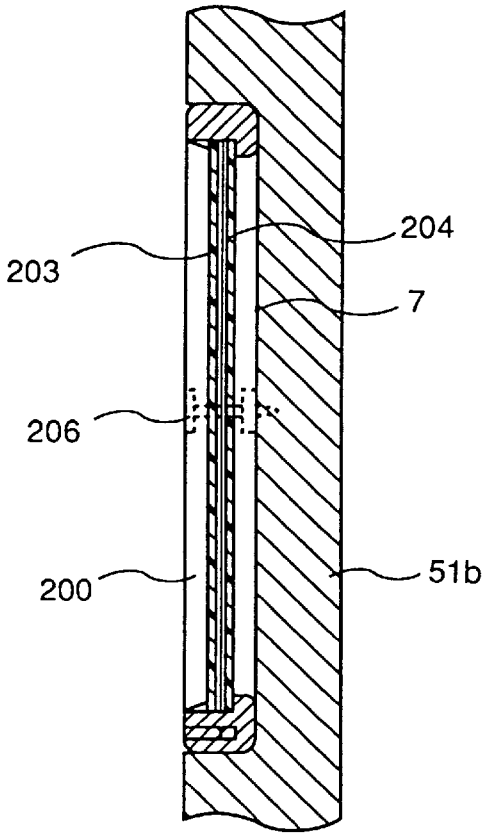
FIG. 33 is a sectional view showing a first state of mounting the frame in the embodiment 4 on a headboard.
Figure 34:
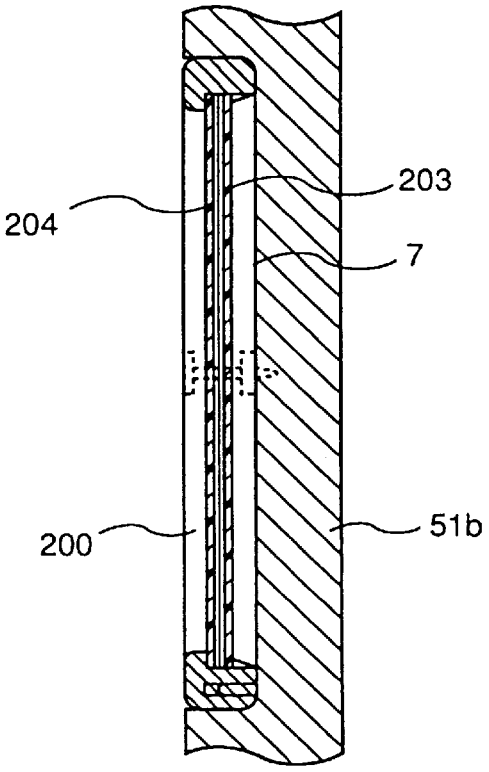
FIG. 34 is a sectional view showing a second state of mounting the frame in the embodiment 4 on the headboard.

The frame 200 consisting of the above structure may be engaged in a frame mounting groove or recess 7 provided on the headboard 51*b* as shown in FIG. 33, and fixed to the headboard 51*b* by employing a mounting screw 206. While the transparent plate 203 side is mounted in a regularly visible state in FIG. 33, the transparent plate 204 side may alternatively be mounted to be regularly visible as shown in FIG. 34.

Also in the frame 200 consisting of the above structure, a character cartoon or the like is inserted in a regularly visible surface side, for example, similarly to the embodiment 3, while a message showing affection to a child or a photograph taken when the child was born is inserted in the opposite side. By making the frame like this, the child sees the message or the photograph when the frame 200 is sometimes detached from the headboard 51*b* and then reversed, whereby it is possible to attain an effect similar to the embodiment 3.

Figure 35:
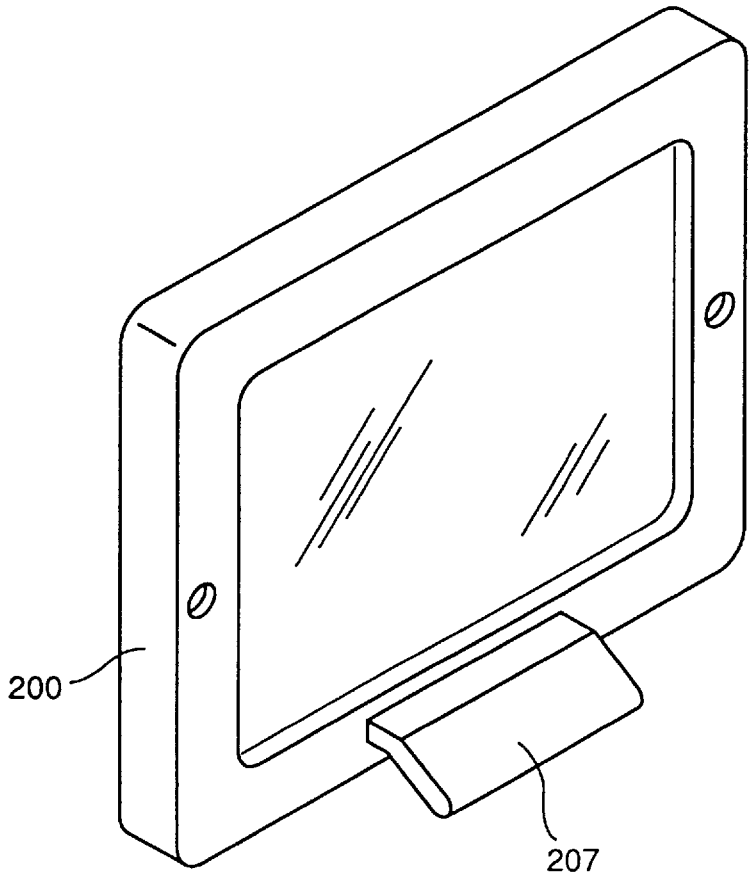
FIG. 35 is a general perspective view showing another used state of the frame in the embodiment 4.

Also when the bed cannot be used, it is possible to make the frame 200 self-sustained by mounting an auxiliary plate 207 on the lower side of the frame 200 as shown in FIG. 35, and an effect similar to the embodiment 3 can be attained also in this case.

(Embodiment 5)

Figure 36:
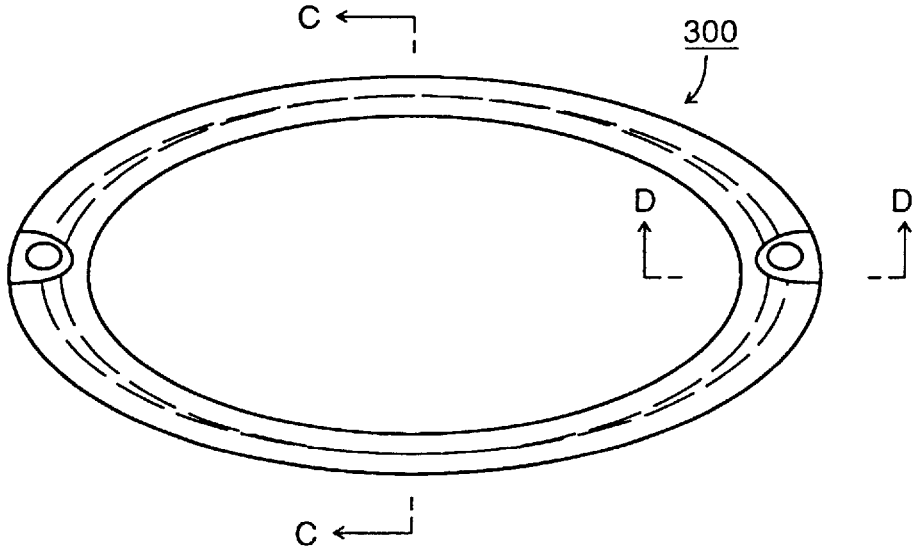
FIG. 36 is a plan view of a frame in an embodiment 5.
Figure 37:
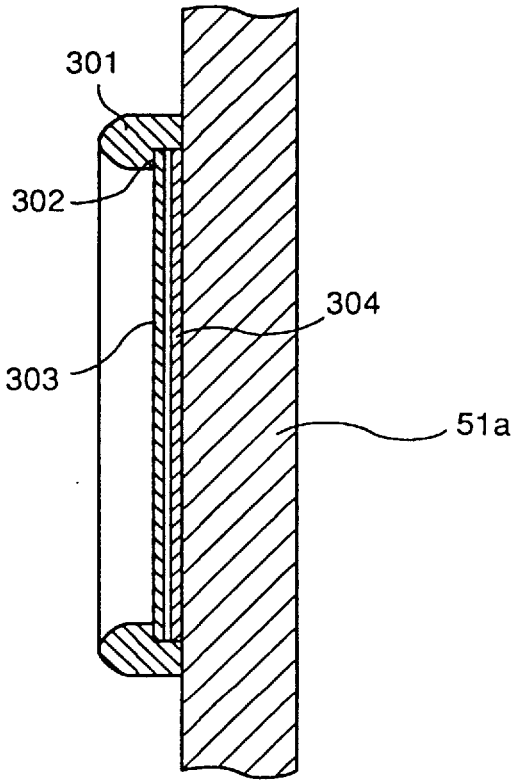
FIG. 37 is a sectional view as viewed along arrow of the line C—C in FIG. 36.
Figure 38:
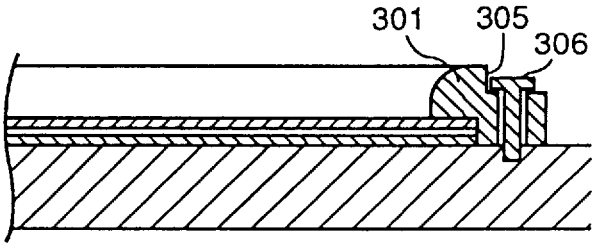
FIG. 38 is a sectional view as viewed along arrow of the line D—D in FIG. 36.

An embodiment 5 based on the present invention is hereafter described with reference to FIG. 36 to FIG. 38.

While the aforementioned embodiment 4 involves the structure of inserting the frame in the frame mounting groove or recess provided in the headboard, a frame 300 mounted on the surfaces of the frame bodies 51 with screws or the like, as shown in FIG. 18, is described in this embodiment 5. FIG. 36 is a front elevational view of the frame 300, FIG. 37 is a sectional view along the arrows of the line C—C in FIG. 36 in a state of mounting the frame 300 on a headboard, and FIG. 38 is a sectional view along the arrows of the line D—D in FIG. 36 in the same state of mounting the frame 300 on the headboard.

The frame 300 in this embodiment 5 has a substantially oval frame 301, and a contact surface 302 provided in the interior periphery of frame 301 on the headboard side thereof for fixing two transparent plates 303 and 304 consisting of acrylic plates or the like, for holding a photograph or the like therebetween.

This frame 300 is fixed to the headboard 51*a* by a screw 306, through a mounting hole 305 provided in the frame 301.

Also in the frame 300 consisting of the above structure, action/effect similar to the aforementioned embodiment 2 can be attained.

In each of the above embodiments, the frame may be sold in a state detached from the bed, so that it is mounted after a message card is inserted at each home. Therefore, a structure suitable for mounting of the frame may be previously prepared on the headboard.

The embodiments disclosed at this time must be considered as being illustrative only, in all points, and not restrictive. Therefore, the shape of the frame is not restricted to a rectangular or oval one either but it is possible to apply various shapes. While the structure of providing the outer frames 101*a*, 101*b* is employed in the frame 100 shown in the embodiment 3, a structure of directly forming the rotation axis 101*i* on the opening 3*a* is also employable. Therefore, it is intended that the scope of the present invention is not limited by the aforementioned description but extends to the scope of the appended claims, including all changes or modifications within the equivalent meaning and range as the scope of the claims.

We claim:

1. A bed comprising a bed part, a frame body enclosing the periphery of said bed part and having a changeable configuration thereby rendering a surface area of said bed part changeable in size from a minimum size suitable for an infant's use of said bed to a maximum size suitable for an adult's use of said bed, and height adjusting means for supporting said bed part and adjusting a height of said bed part relative to a floor face, wherein said height adjusting means comprises a leg part that includes two leg members pivotally joined together at a substantially central portion for adjusting the height of said bed part from the floor face by being pivotally bent about said substantially central portion in an inverted V shape.

2. The bed in accordance with claim 1, wherein said frame body comprises a plurality of frame members and a slide mechanism slidably holding and allowing at least one of said frame members to slidably move in a vertical direction with respect to said bed part.

3. The bed in accordance with claim 1, further comprising a swing shaft coupled to said height adjusting means and swingably supporting said bed part with respect to said height adjusting means.

4. The bed in accordance with claim 1, further comprising a picture frame for storing graphical indicia or a visual image, said picture frame being detachably mounted on said frame body.

5. The bed in accordance with claim 4, wherein said picture frame has a stand base making said picture frame self-supporting when said picture frame is detached from said frame body and placed on a horizontal surface.

6. The bed in accordance with claim 4, wherein said frame body has an opening therein for detachably receiving said picture frame in said opening.

7. The bed in accordance with claim 6, wherein said picture frame is rotatably mounted on an axis in said opening.

8. The bed in accordance with claim 7, further comprising an outer frame having a pair of projection parts forming said axis in a central portion of an upper side and a central portion of a lower side of said outer frame, wherein said outer frame is inserted in a peripheral edge portion of said opening of said frame body, and said picture frame has a pair of bearing concave parts for receiving said pair of projection parts of said outer frame in a central portion of an upper side and a central portion of a lower side of said picture frame.

9. The bed in accordance with claim 8, wherein said outer frame comprises a first outer frame member and a second outer frame member respectively adapted to be inserted into said opening from two opposite sides thereof so as to engage said frame body with said first and second outer frame members from said two opposite sides.

10. The bed in accordance with claim 8, wherein said picture frame comprises two transparent plates for holding said graphical indicia or said visual image therebetween, a first inner frame having a notch for receiving peripheral edge portions of said two transparent plates on an inner surface side of said first inner frame, and a second inner frame adapted to be joined with said first inner frame for holding said two transparent plates between said first and second inner frames, and wherein said bearing concave parts are formed mutually on surfaces of said first inner frame and said second inner frame.

11. The bed in accordance with claim 4, wherein said frame body has a concavity therein for detachably receiving said picture frame in said concavity.

12. The bed in accordance with claim 4, wherein said picture frame comprises two transparent plates for holding said graphical indicia or visual image therebetween, an inner frame enclosing peripheral edge portions of said two transparent plates and supporting first surface sides of said peripheral edge portions, and an elastic member provided on said inner frame for urging second surface sides of said peripheral edge portions opposite said first surface sides toward said first surface sides.

13. The bed in accordance with claim 4, wherein a lower side of said picture frame has a greater width than does an upper side of said picture frame.

14. The bed in accordance with claim 4, wherein said picture frame has on a lower side thereof a hole adapted for mounting an auxiliary stand member by which said picture frame can be standingly supported when said picture frame is detached from said bed.

15. The bed in accordance with claim 1, wherein said height adjusting means is so configured and adapted to be capable of adjusting the height of said bed part to a first height that is suitable as a baby bed employed for a baby, and a second height that is lower than said first height and that is suitable as an extended bed for a person more grown-up than a baby, wherein said surface area of said bed part is expanded by changing the configuration of said frame body when the height of said bed part is adjusted to said lower second height.

16. The bed in accordance with claim 15, wherein said frame body comprises four panels surrounding said bed part on all sides, and the configuration of said frame body is changeable to expand said surface area of said bed part by reclining the one of said panels located at a foot end of said bed part.

17. The bed in accordance with claim 1, wherein said height adjusting means is so configured and adapted to be capable of adjusting the height of said bed part to a first height that is suitable as a baby bed employed for a baby, and a third height that is lower than said first height and that is suitable as a sofa, wherein the configuration of said frame body is changed so that said bed can be used as a sofa when the height of said bed part is adjusted to said third height.

18. The bed in accordance with claim 17, wherein said frame body comprises three panels surrounding said bed part on a head end, a foot end and one side thereof and not at another side thereof when the configuration of said frame body is changed to adapt the bed to be used as a sofa.

19. The bed in accordance with claim 1, wherein said frame body comprises four panels surrounding said bed part on all sides, wherein a first one of said panels positioned at a lengthwise extending side of said bed part is removable such that the configuration of said frame body can be changed to make said bed usable as a sofa, wherein a second one of said panels positioned at a foot end of said bed part is pivotally reclinable such that the configuration of said frame body can be changed by reclining said second panel thereby expanding the surface area of said bed part in a direction toward said foot end and thus forming an extended bed, and wherein said height adjusting means is so configured and adapted to be able to adjust the height of said bed part to any one of a first height that is suitable for serving as a baby bed, a second height that is suitable for serving as said sofa, and a third height that is suitable for serving as said extended bed.

20. A bed comprising a bed frame body including a bed part and a pair of panels being pivotally connected to respective opposite ends of said bed part, such that said panels are pivotally inclinable from respective at least nearly vertical positions to respective at least nearly horizontal positions, whereby a surface area of said bed frame body can be adjusted from a smaller infant size to a larger adult size, a bed base part having an adjustable height, and two swing shafts coupling and swingably supporting said bed frame body from said bed base part, wherein said swing shafts are respectively pivotally supported on pivotal parts provided respectively proximate to two opposite ends of said bed base part and extend downwardly from said pivotal parts to supporting parts provided at respective lower ends of said panels to swingably support said panels so that an upper surface of said bed part is positioned above an upper surface of said bed base part in a state in which said panels are pivoted to said respective at least nearly vertical positions.

21. A bed comprising a bed frame body including a first coupling member and a second coupling member being arranged in parallel with each other, a reclinable first panel, and a reclinable second panel, wherein substantially central portions of said first and second panels are respectively pivotally connected to axis parts provided respectively proximate respective opposite ends of said first and second coupling members such that said panels are pivotally inclinable from respective at least nearly vertical positions to respective least nearly horizontal positions, whereby a surface area of said bed frame body can be adjusted from a smaller infant size to a larger adult size, said bed further comprising a base including a first base member and a second base member being arranged in parallel with said first and second coupling members for supporting said bed frame body at an adjustable height above a floor, a first swing shaft and a second swing shaft respectively extending between said first and second base members and swingably supporting said bed frame body, and respectively having U-shapes with central portions rotatably supporting sliding parts provided on lower portions of said first and second panels, and end portions upwardly extending from said central portions, wherein first ones of said end portions are pivotally supported by pivotal parts of said first base member and second ones of said end portions are pivotally supported by pivotal parts of said second base member so that a plane including an upper surface of said first coupling member and an upper surface of said second coupling member is positioned above a plane including an upper surface of said first base member and an upper surface of said second base member in a state in which said first panel and said second panel are pivoted to said respective at least nearly vertical positions.

22. The bed in accordance with claim 21, wherein said first base member comprises a first base bar being arranged in parallel with respect to said first coupling member and provided with said pivotal part, and a first leg part being mounted on said first base bar and being pivotally bendable at a substantially central portion thereof to be capable of adjusting the height of said first base bar above the floor by being pivotally bent at said substantially central portion, and said second base member comprises a second base bar being arranged in parallel with respect to said second coupling member and provided with said pivotal part, and a second leg part being mounted on said second base bar and being pivotally bendable at a substantially central portion thereof to be capable of adjusting the height of said second base bar above the floor by being pivotally bent at said substantially central portion.

23. The bed in accordance with claim 22, further comprising a second auxiliary member arranged to extend between and interconnect said first and second leg parts in a position such that said second auxiliary member comes into contact with a lower surface of said first panel and a lower surface of said second panel in a state in which said first leg part and said second leg part are respectively pivotally most straightened at said central portions and in which said first panel and said second panel are in said respective at least nearly horizontal positions.

24. The bed in accordance with claim 21, further comprising a first auxiliary member arranged to extend between and interconnect said first and second base bars, in a position such that said first auxiliary member comes into contact with a lower surface of said first coupling member and a lower surface of said second coupling member in a state in which said first panel and said second panel are in said respective at least nearly horizontal positions.

25. A bed comprising a bed part, a frame body enclosing the periphery of said bed part and having a changeable configuration thereby rendering a surface area of said bed part changeable in size from a minimum size suitable for an infant's use of said bed to a maximum size suitable for an adult's use of said bed, height adjusting means for supporting said bed part and adjusting a height of said bed part relative to a floor face, and a swing shaft coupled to said height adjusting means and swingably supporting said bed part with respect to said height adjusting means.

* * * * *